US010065829B2

(12) United States Patent
Nakayama et al.

(10) Patent No.: US 10,065,829 B2
(45) Date of Patent: Sep. 4, 2018

(54) SHEET POST-PROCESSING DEVICE AND IMAGE FORMING SYSTEM

(71) Applicant: Konica Minolta, Inc., Chiyoda-ku, Tokyo (JP)

(72) Inventors: Naoya Nakayama, Toyokawa (JP); Riichi Hama, Toyokawa (JP); Ryo Morita, Toyohashi (JP); Takuya Inoue, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/745,849

(22) Filed: Jun. 22, 2015

(65) Prior Publication Data

US 2015/0368059 A1 Dec. 24, 2015

(30) Foreign Application Priority Data

Jun. 20, 2014 (JP) ..... 2014-126931

(51) Int. Cl.
*B65H 31/30* (2006.01)
*B65H 31/02* (2006.01)
(Continued)

(52) U.S. Cl.
CPC ..... *B65H 31/3081* (2013.01); *B65H 31/02* (2013.01); *B65H 31/3045* (2013.01);
(Continued)

(58) Field of Classification Search
CPC . B65H 9/002; B65H 9/10; B65H 9/12; B65H 31/34; B65H 31/36; B65H 37/04;
(Continued)

(56) References Cited

U.S. PATENT DOCUMENTS 7,780,160 B2 * 8/2010 Sato ..... B42C 9/0037 270/32
7,862,016 B2 * 1/2011 Takemoto ..... B65H 45/18 270/17
(Continued)

FOREIGN PATENT DOCUMENTS

JP H08290862 A 11/1996
JP 2001122491 A 5/2001
(Continued)

OTHER PUBLICATIONS

Japanese Notification of Reasons for Refusal corresponding to Patent Application No. 2014-126931; Mailing Date: Apr. 5, 2016, with English translation.
(Continued)

*Primary Examiner* — David H Bollinger
(74) *Attorney, Agent, or Firm* — Cantor Colburn LLP

(57) ABSTRACT

A sheet post-processing device for, after sheets that are ejected from an image forming device are stored on a storage tray, transporting the sheets in a transport direction to a post-processing position and performing post processing at the post-processing position, including: an aligner configured to align sheets on the storage tray; and a transporter configured to transport to the post-processing position a stack of sheets aligned by the aligner. The transporter includes a first contact member and a second contact member, and transports the stack to the post-processing position by causing the first contact member and the second contact member to simultaneously move in the transport direction while causing the first contact member to be in contact with a rear end portion of the stack in the transport direction and the second contact member to be in contact with a leading end portion of the stack in the transport direction.

12 Claims, 26 Drawing Sheets

(51) Int. Cl.
*B65H 31/38* (2006.01)
*B65H 37/04* (2006.01)

(52) U.S. Cl.
CPC ..... *B65H 31/38* (2013.01); *B65H 37/04* (2013.01); *B65H 2301/342* (2013.01); *B65H 2301/4212* (2013.01); *B65H 2405/1117* (2013.01); *B65H 2405/11151* (2013.01); *B65H 2408/1222* (2013.01); *B65H 2511/10* (2013.01); *B65H 2511/20* (2013.01); *B65H 2801/27* (2013.01)

(58) Field of Classification Search
CPC ..... B65H 9/00; B65H 31/02; B65H 31/3045; B65H 31/38; B65H 31/3081
USPC ..... 270/58.12, 58.17, 58.27; 271/241, 220
See application file for complete search history.

(56) References Cited

U.S. PATENT DOCUMENTS 7,866,648 B2 * 1/2011 Noh ..... G03G 15/6544 270/58.07
2007/0063413 A1 * 3/2007 Terao ..... B42C 1/12 270/58.12
2008/0237964 A1 * 10/2008 Kiriyama ..... B42C 1/125 270/58.27
2013/0270763 A1 * 10/2013 Furuhashi ..... B65H 39/00 270/58.08

FOREIGN PATENT DOCUMENTS

JP 2002154739 A 5/2002
JP 2012171701 A 9/2012
JP 2012229108 A 11/2012
JP 2013035663 A 2/2013
JP 2014005144 A 1/2014

OTHER PUBLICATIONS

Chinese First Office Action corresponding to Application No. 201510345474.4; dated Aug. 30, 2016, with English translation.
Japanese Notification of Reasons for Refusal corresponding to Patent Application No. 2014-126931; dated Oct. 18, 2016, with English translation.
SIPO Second Office Action for corresponding Chinese Application No. 201510345474.4; dated of Jul. 12, 2017.
SIPO Third Office Action for corresponding CN Application No. 201510345474.4; datd Dec. 18, 2017.

* cited by examiner

SHEET POST-PROCESSING DEVICE AND IMAGE FORMING SYSTEM

CROSS REFERENCE TO RELATED APPLICATIONS

The present invention claims priority under 35 U.S.C. § 119 to Japanese Application No. 2014-126931, filed Jun. 20, 2014, the entire content of which is incorporated herein by reference.

BACKGROUND OF THE INVENTION

1. Field of the Invention

The present invention is related to a sheet post-processing device for an image forming device and an image forming system including an image forming device and a sheet post-processing device.

2. Description of the Related Art

A sheet post-processing device performing post-processing such as stapling, punching, and bookbinding processing on sheets outputted from an image forming device typically performs alignment processing for aligning edges of a sheet stack before performing the post-processing.

An aligned sheet stack is transported to a post-processing location and subjected to post-processing. In order to ensure that alignment of the sheet stack is not lost during transport, for example, Japanese Patent Application Publication H8-290862 (Patent Literature 1) discloses post-processing (bookbinding) in which the post-processing is performed by temporarily stacking a sheet stack in a storage tray to align the sheet stack, then, while gripping a leading end of the sheet stack via a sheet stack clamp mechanism, moving the sheet stack to another, lower, tray for bookbinding, and binding the sheet stack using bind tape.

According to a method of gripping a leading end of a sheet stack to move the sheet stack as described in Patent Literature 1, and in particular in cases in which the number of sheets in a single sheet stack is high, only sheets at a surface of the sheet stack are gripped and there is a high possibility of problems occurring such as sheets in a central portion of the stack falling out, also known as dropout, and alignment of the sheet stack being lost.

SUMMARY OF THE INVENTION

The present invention was achieved in light of the above technical problems, and aims to provide a sheet post-processing device and an image forming system including an image forming device and the sheet post-processing device, each of which maintains alignment of a sheet stack until the sheet stack is moved to a post-processing location for post-processing.

In order to achieve the above aim, a sheet post-processing device pertaining to one aspect of the present invention is a sheet post-processing device for, after sheets that are ejected from an image forming device are stored on a storage tray, transporting the sheets in a transport direction to a post-processing position and performing post processing at the post-processing position, the sheet post-processing device comprising: an aligner configured to align sheets on the storage tray; and a transporter configured to transport to the post-processing position a stack of sheets aligned by the aligner, wherein the transporter includes a first contact member and a second contact member, and the transporter transports the stack to the post-processing position by causing the first contact member and the second contact member to simultaneously move in the transport direction while causing the first contact member to be in contact with a rear end portion of the stack in the transport direction and the second contact member to be in contact with a leading end portion of the stack in the transport direction.

Further, as another aspect of the present invention, an image forming system is an image forming system comprising: an image forming device provided with an image reader and an image former below the image reader, and having a space therebetween, at least part of the space defining an opening to a front side of the image forming device; and a sheet post-processing device disposed in the space of the image forming device, wherein the sheet post-processing device is for, after sheets that are ejected from the image forming device are stored on a storage tray, transporting the sheets in a transport direction to a post-processing position and performing post processing at the post-processing position, the sheet post-processing device comprising: an aligner configured to align sheets on the storage tray; and a transporter configured to transport to the post-processing position a stack of sheets aligned by the aligner, wherein the transporter includes a first contact member and a second contact member, and the transporter transports the stack to the post-processing position by causing the first contact member and the second contact member to simultaneously move in the transport direction while causing the first contact member to be in contact with a rear end portion of the stack in the transport direction and the second contact member to be in contact with a leading end portion of the stack in the transport direction.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings.

DESCRIPTION OF THE PREFERRED EMBODIMENT

The following describes a sheet post-processing device and an image forming system according to a preferred embodiment of the present invention, with reference to the drawings.

Overall Configuration of Image Forming System

Figure 1:
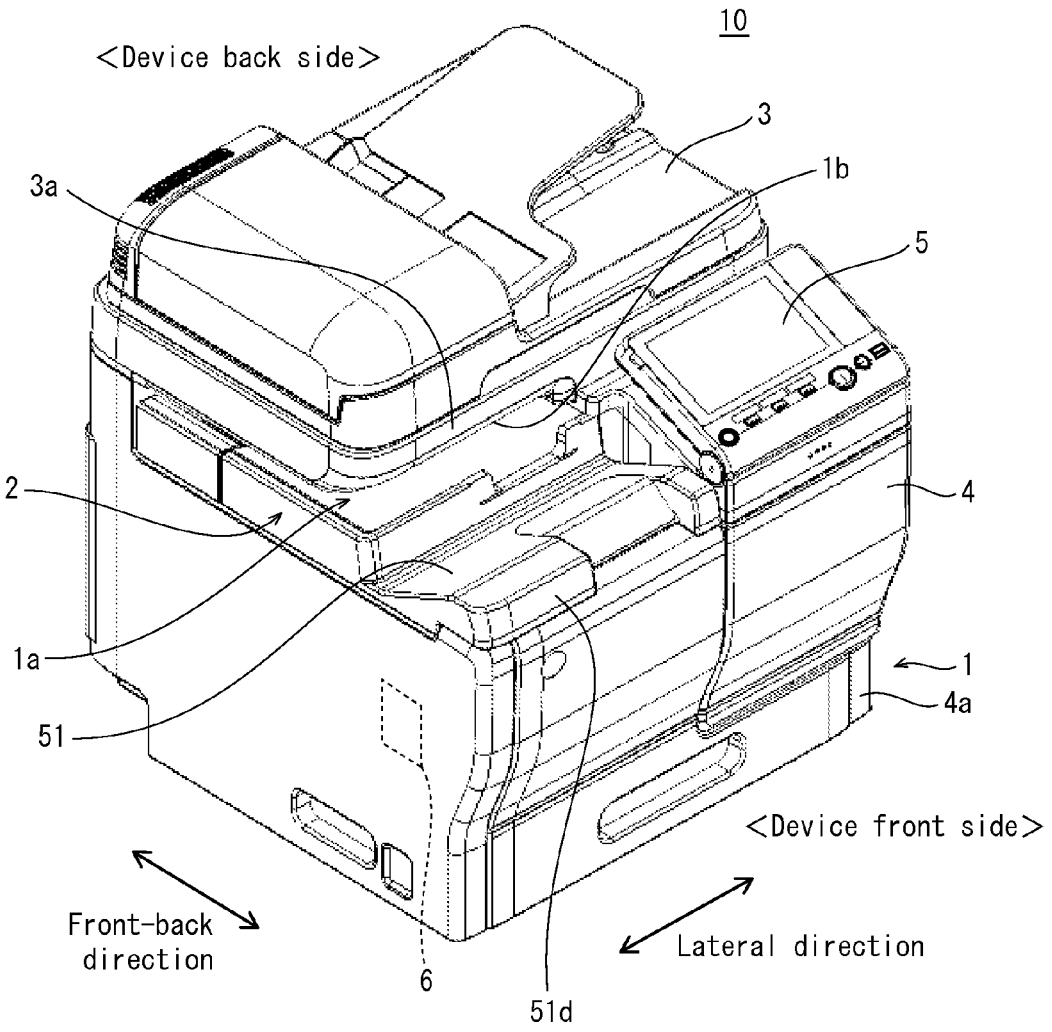
FIG. 1 shows an overall configuration of an image forming system including an image forming device and sheet post-processing device.

FIG. 1 is an external perspective view of an overall configuration of the image forming system.

As shown in the drawing, an image forming system 10 includes an image forming device 1 and a sheet post-processing device 2 mounted to the image forming device 1.

The image forming device 1 includes a scanner 3, a printer 4, an operation unit 5, and a controller 6. The image forming device 1 is an internal ejection type in which the printer 4 is positioned below the scanner 3 and separated by a space 1*a*, at least part of the space 1*a* defining an opening 1*b* to a device front side of the image forming device 1. The image forming device 1 has functions of (i) receiving a scan job of reading an image of a document, a copy job of printing a document image to a sheet based on image data obtained by reading, and a job request from an external terminal (not illustrated) via a network, and (ii) executing each kind of job, such as a print job of printing to a sheet an image pertaining to a received job.

The scanner 3 (image reader) transports a document that is set to obtain image data by reading an image of the document.

The printer 4 (image former) forms an image (prints) on a sheet, based on either image data obtained by the scanner 3 or data of a print job from an external terminal.

Figure 3:
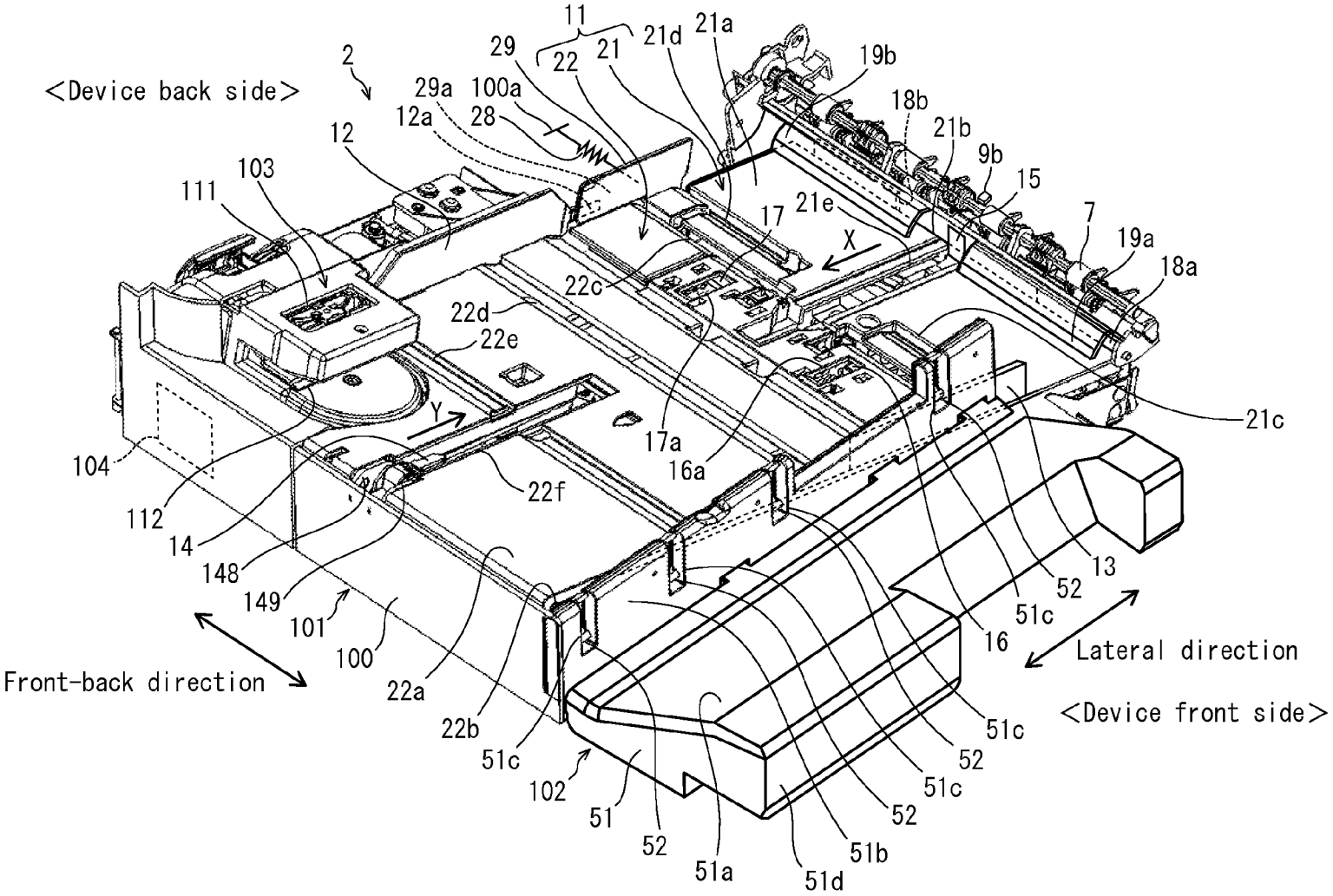
FIG. 3 is a schematic perspective view of only the sheet post-processing device.

The printer 4, during image forming, is fed sheets one sheet at a time from a cassette 4*a* located below the printer 4, forms an image on each sheet so fed, and ejects each sheet on which an image is formed, one sheet at a time, by using an ejection roller 7 (FIG. 3). An ejected sheet is transported into the sheet post-processing device 2 located in the space 1*a*. Note that the printer 4 is not limited to being an electrophotographic type and may, for example, be an inkjet type.

The operation unit 5 is positioned at a location at which a user can easily operate the operation unit 5 while standing in front of the image forming device 1. The operation unit 5 receives input operations from a user such as input of the number of copies, an instruction to start a job such as copying, an instruction to stop a job, and an instruction to execute post-processing at the sheet post-processing device 2, in this case stapling, and transmits received content to the controller 6.

The controller 6 receives input information from the operation unit 5 according to the user and controls the scanner 3 and the printer 4 to smoothly execute jobs according to instructions from the user. Further, when execution of post-processing is instructed, the controller 6 communicates such an instruction to the sheet post-processing device 2 and causes the indicated post-processing to be executed.

In the following description, a side of the image forming device 1 at which the operation unit is positioned is called the device front side, and when viewing the image forming device 1 from the device front side, a rear side of the device (far side) is called a device back side, a right side is called a device right side, and a left side is called a device left side. A direction connecting the device front side and the device back side is called a device front-back direction and a left-right direction perpendicular to the device front-back direction is called a device lateral direction.

Figure 2:
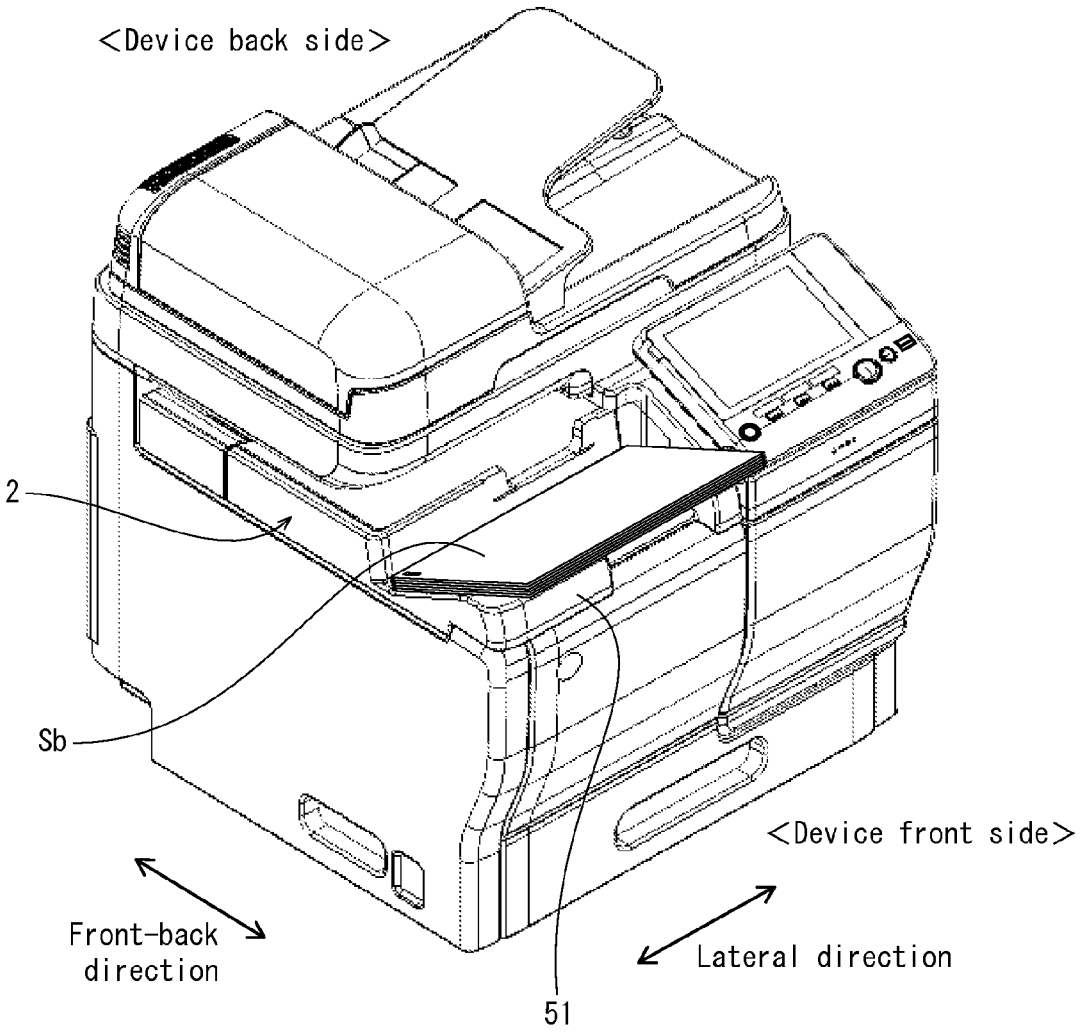
FIG. 2 is a perspective view showing a state in which a sheet stack is stored in a front tray of the sheet post-processing device.

The sheet post-processing device 2 is provided to the image forming device 1 and positioned in the space 1*a*, at least a part of which defines the opening 1*b* (FIG. 1) to the device front side. The sheet post-processing device 2 has a stapling function of stapling a sheet stack composed of a plurality of sheets ejected from the printer 4, and, after stapling, stores a sheet stack Sb on a front tray 51 provided to the device front side, as shown in FIG. 2.

Configuration of Sheet Post-Processing Device

The following describes configuration of the sheet post-processing device 2.

FIG. 3 is an overall perspective view of the sheet post-processing device 2 viewed from above and to the left of the device front, shown for convenience with an ejection roller 7 of the printer 4.

As shown in the drawing, the sheet post-processing device 2 includes a first storage portion 102, a second storage portion 102, a stapler 103, and a controller 104.

1. Configuration of First Storage Portion 101

The first storage portion 101 temporarily stores a sheet ejected from the ejection roller 7 of the printer 4, and includes a post-processing tray 11, a CD reference plate 12, a CD alignment plate 13, an FD alignment member 14 (second contact member), an FD transport member 15 (first contact member), and guide claws 16, 17.

(1) Post-Processing Tray

The post-processing tray 11 (first tray) includes a fixed tray 21 and a pivot tray 22. The fixed tray 21 and the pivot tray 22 are arranged in the stated order along a transport direction of a sheet ejected by the ejection roller 7 of the printer 4 (direction indicated by an arrow X in FIG. 4). Hereafter, the direction indicated by the arrow X above the post-processing tray 11 is referred to as a sheet transport direction.

The fixed tray 21 is fixed to and supported on a device body 100 of the sheet post-processing device 2.

The pivot tray 22 is supported by the device body 100 and an end 22*c* of a sheet transport direction upstream side of the pivot tray 22 is pivotable up and down around a support shaft 22*b* provided to an end of a sheet transport direction downstream side of the pivot tray 22.

Figure 20:
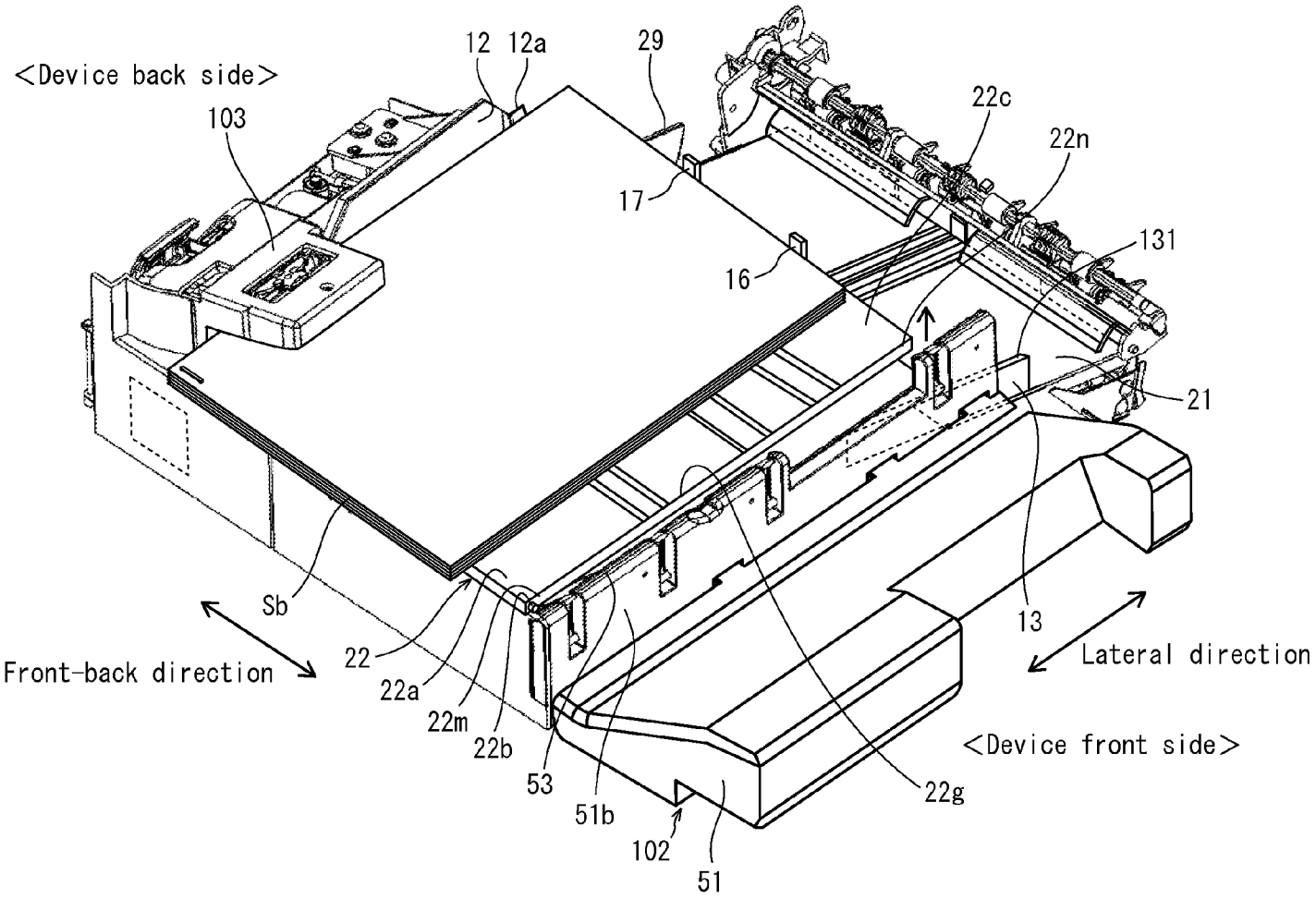
FIG. 20 is a schematic perspective view showing a state in which a pivot tray is transitioned to a horizontal orientation.

FIG. 3 shows the end 22*c* of the pivot tray 22 located in a lowermost position in an inclined orientation. Sheet stacking surfaces of the fixed tray 21 and the pivot tray 22 are shown in a state in which the sheet stacking surfaces are substantially on the same plane. However, as described later, when transporting a sheet on the pivot tray 22 to the device front side, the end 22*c* of the pivot tray 22 rises so that the pivot tray 22 transitions to a horizontal orientation (FIG. 20).

Pivoting of the pivot tray 22 is performed by, for example, drive power of a lift motor M5 (FIG. 23) located below the pivot tray 22 driving a cam mechanism (not illustrated). As long as a mechanism allows movement upwards and downwards, mechanisms other than the cam mechanism may be used.

An upper surface of the fixed tray 21 is a sheet stacking surface 21*a* and an upper surface of the pivot tray 22 is a sheet stacking surface 22*a*.

At an end 21*b* of a sheet transport direction upstream side of the sheet stacking surface 21*a*, two plate-shaped stoppers 18*a*, 18*b* are arranged upright along the device front-back direction, with an interval in-between.

The stoppers 18*a*, 18*b* are used as restriction members of a rear end side of a sheet when the sheet on the post-processing tray 11 is aligned in the sheet transport direction. Aligning a sheet in the sheet transport direction is called FD alignment.

Holding guides 19*a*, 19*b* are located directly above the stoppers 18*a*, 18*b*, a predefined interval separating the holding guides 19, 19*b* from the stoppers 18*a*, 18*b*. The holding guides 19*a*, 19*b* change an orientation of a sheet ejected from the ejection roller 7 of the printer 4 to a downwards-facing orientation, guiding the sheet to the fixed tray 21.

A single sheet that passes the holding guides 19*a*, 19*b* to be guided onto the fixed tray 21 is stacked on the sheet stacking surface 21*a* of the fixed tray 21. However, in a case in which the sheet is longer than the fixed tray 21 in the sheet transport direction, the sheet is stacked spanning the sheet stacking surfaces 21*a*, 22*a* of both the fixed tray 21 and the pivot tray 22.

(2) CD Reference Plate

The CD reference plate 12 is used as a position determining member to determine a reference position when aligning a sheet on the post-processing tray 11 in the device front-back direction, and is oriented perpendicular to the sheet stacking surface 22*a* of the pivot tray 22 and parallel to the sheet transport direction. The CD reference plate 12 is supported to be movable in the device front-back direction along two grooves 22*d*, 22*e* in the sheet stacking surface 22*a* that are elongated in the device front-back direction and separated by an interval in the sheet transport direction. Aligning a sheet in the device front-back direction is called CD alignment.

FIG. 3 shows a state in which the CD reference plate 12 is positioned in a home position that is farthest towards the device back side. During CD alignment, the CD reference plate 12 moves only a predefined distance from its home position (for example, 10 mm) towards the device front side and stops. This stationary position is a reference position for CD alignment. This reference position is also a reference for a stapling position in the device front-back direction for the stapler 103.

Figure 23:
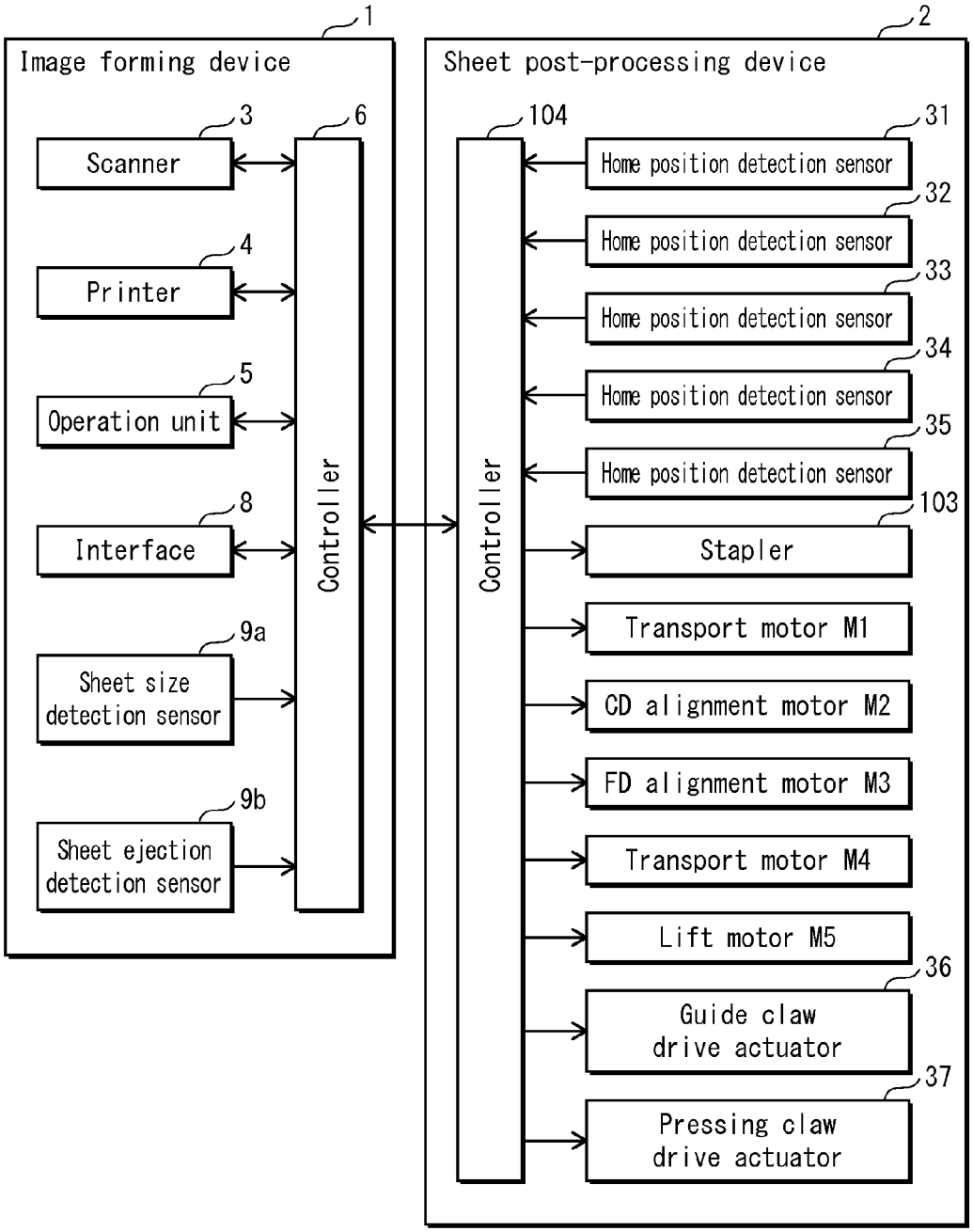
FIG. 23 is a block diagram for describing control configuration of each of the image forming device and the sheet post-processing device.

Further, the CD reference plate 12 is also serves as a means of transporting a sheet on the post-processing tray 11 to the front tray 51 of the second storage portion 102 by moving to a position farthest towards the device front side, as described later. Movement of the CD reference plate 12 is performed by drive power of a transport motor M4 (FIG. 23). For example, the CD reference plate 12 is connected to a rotary shaft of the transport motor M4 via a rotation wire (not illustrated) tensioned between at least two pulleys. The rotation wire is rotated by drive power from the transport motor M4 and the drive power is transmitted to the CD reference plate 12, enabling movement of the CD reference plate 12 (wire drive).

Movement of the CD reference plate 12 is not limited to being achieved by wire drive, and may, for example, be achieved by a screw feed mechanism directly moving the CD reference plate 12. The CD alignment plate 12, the FD alignment member 14, and the FD transport member 15 may also adopt similar movement mechanisms to that of the CD reference plate.

(3) CD Alignment Plate

The CD alignment plate 13 is a member for CD alignment of sheets on the post-processing tray 11, and is oriented perpendicular to the sheet stacking surface 21*a* of the fixed tray 21 and parallel to the sheet transport direction. The CD alignment plate 13 is supported by the fixed tray 21 to be movable in the device front-back direction along a groove 21*c* in the sheet stacking surface 21*a* that is elongated in the device front-back direction. FIG. 3 shows the CD alignment plate 13 positioned in a home position farthest towards the device front side. Movement of the CD alignment plate 13 is achieved by drive power of the CD alignment motor M2 (FIG. 23).

A CD reference plate 29 is positioned at an end of a device back side of the fixed tray 21, facing the CD alignment plate 13 and farther upstream in the sheet transport direction than the CD reference plate 12.

The CD reference plate 29 has a same CD alignment function as the CD reference plate 12, and is oriented perpendicular to the sheet stacking surface 21*a* of the fixed tray 21 and parallel to the sheet transport direction. The CD reference plate 29 is supported to be movable in the device front-back direction along a groove 21*d* in the sheet stacking surface 21*a* that is elongated in the device front-back direction.

The CD reference plate 29 is connected to a portion 100*a* of the device body 100 via a tension spring 28. According to a biasing force acting in a direction towards the device back side caused by the tension spring 28, a surface 29*a* on a device back side of the CD reference plate 29 is normally in contact with a protrusion 12*a* provided to an end of a sheet transport direction upstream side of the CD reference plate 12.

Accordingly, when the CD reference plate 12 moves towards the device front side, force towards the device front side is transferred to the CD reference plate 29 via the protrusion 12*a*, against the biasing force of the tension spring 28, moving the CD reference plate 29 towards the device front side together with the CD reference plate 12.

On the other hand, when the CD reference plate 12 moves towards the device back side, the CD reference plate 29 moves together with the CD reference plate 12, maintaining contact with the protrusion 12*a* of the CD reference plate 12, according to the biasing force of the tension spring 28. In this way, the CD reference plate 12 is a driving side and the CD reference plate 29 is a driven side.

The CD reference plate 29 is restricted so that it does not move further towards the device back side than its home position, and when the pivot tray 22 is transitioned to the horizontal orientation, as described later, and engagement between the CD reference plate 29 and the protrusion 12*a* of the CD reference plate 12 is released (see FIG. 20), the CD reference plate 29 returns to its home position due to the biasing force of the tension spring 28.

(4) FD Transport Member

The FD transport member 15 is a contact member for moving a sheet stacked on the post-processing tray 11 along the sheet transport direction. The FD transport member 15 is supported so that an upper portion protrudes from a groove 21*e* in the sheet stacking surface 21*a* of the fixed tray 21 that is elongated in the sheet transport direction. The FD transport member 15 is movable along the groove 21*e*.

Figure 9:
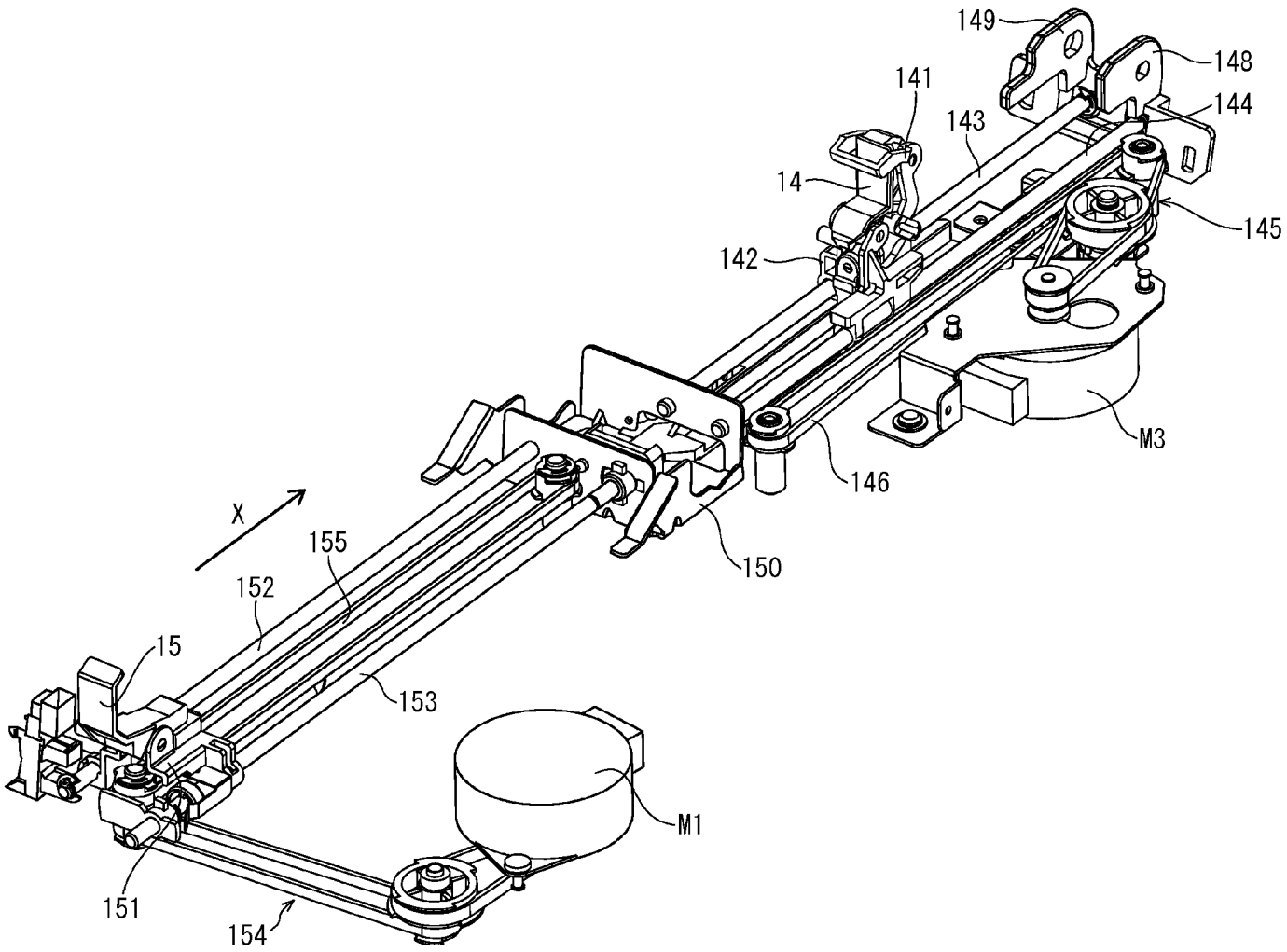
FIG. 9 is a perspective view showing a configuration of a movement mechanism of the FD transport member and the FD alignment member.

FIG. 3 shows a state in which the FD transport member 15 is positioned at a home position that is farthest upstream in the sheet transport direction. The home position of the FD transport member 15 is slightly farther upstream in the sheet transport direction than the stoppers 18*a*, 18*b* (see FIG. 6). Movement of the FD transport member 15 is achieved by drive power of a transport motor M1 (FIG. 9).

(5) FD Alignment Member

The FD alignment member 14 is used for FD alignment of sheets on the post-processing tray 11 and is supported to be movable back and forth along a groove 22*f* provided in the sheet stacking surface 22*a* of the pivot tray 22 that is elongated in the sheet transport direction.

Figure 4:
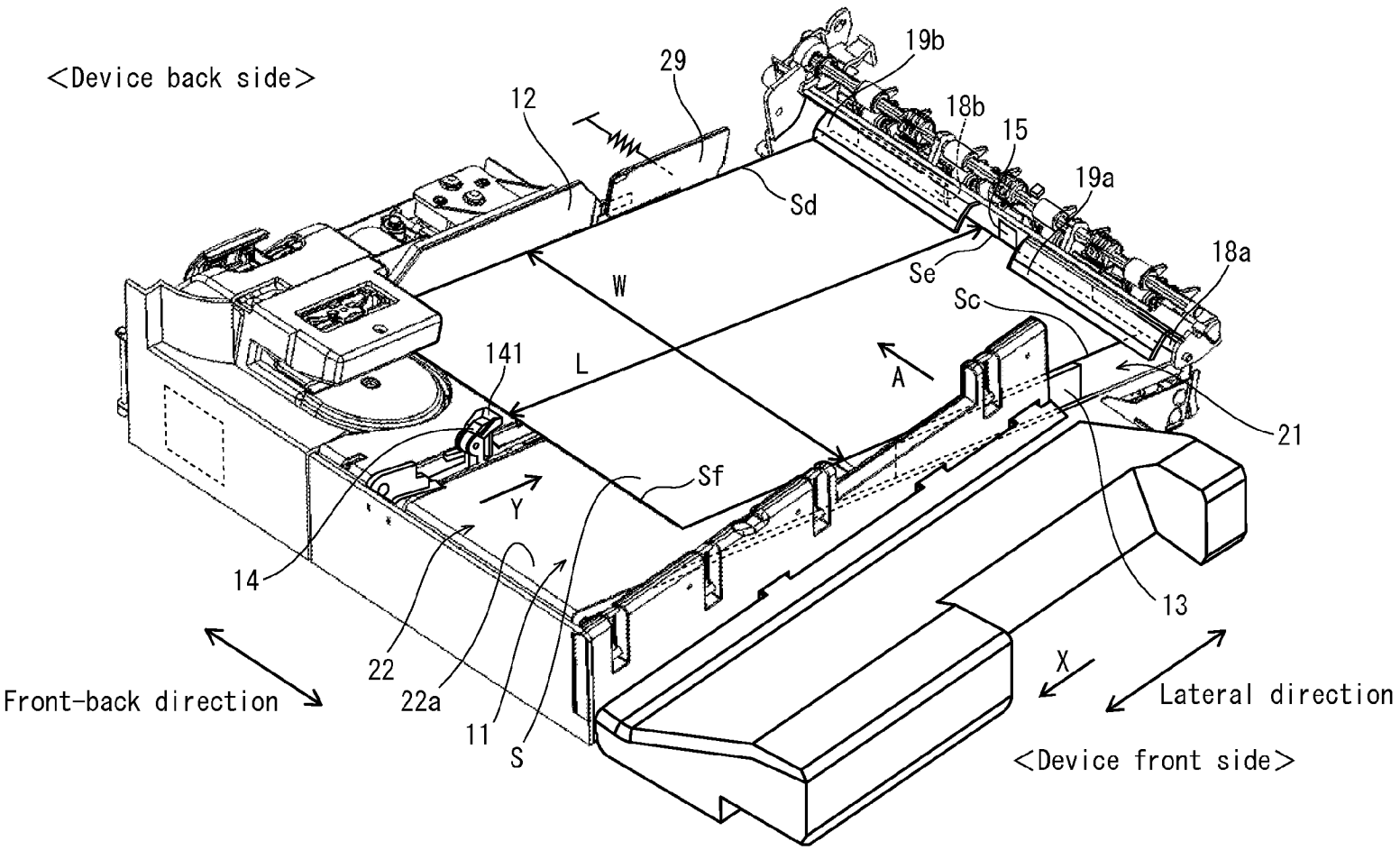
FIG. 4 is a schematic perspective view of a state in which a first sheet is aligned after being ejected onto a post-processing tray.

The FD alignment member 14, in its home position shown in FIG. 3, is in contact with guide plates 148, 149, and is therefore in a retracted orientation (retracted state) retracted into the groove 22*f* of the pivot tray 22. However, when the FD alignment member 14 moves from its home position in an opposite direction to the sheet transport direction (a Y direction indicated by an arrow), an end of the FD alignment member 14 rises and protrudes above the groove 22*f*, and this is called a protruding orientation (FIG. 4). Movement of the FD alignment member 14 is achieved by drive power of an FD alignment motor M3 (FIG. 23).

Further, the FD alignment member 14 has a gripping claw 141 (see FIG. 4). After FD alignment of a sheet stack Sb, when the sheet stack Sb is pushed and transported to the stapling position by the FD transport member 15, the gripping claw 141 closes to push a leading end portion of the sheet stack Sb against a horizontal portion 14*a* of the FD alignment member 14 (see FIG. 11, FIG. 12, FIG. 14, etc.) and the FD alignment member 14 moves to pull up the sheet stack Sb while gripping the leading end portion thereof. Accordingly, in the present embodiment, the gripping claw 141 and the FD alignment member 14 cooperate to function as a "gripping member".

Timing of movement of the FD transport member 15 and the FD alignment member 14, and gripping/releasing of the sheet stack Sb by the gripping claw 141, are described in detail later.

(6) Guide Claw

Returning to FIG. 3, the guide claws 16, 17 are located within holes 16*a*, 17*a* provided in the sheet stacking surface 22*a* near the end 22*c* of the sheet transport direction upstream side of the pivot tray 22. The guide claws 16, 17 are supported by the pivot tray 22 to be switchable between a retracted state retracted inside the holes 16*a*, 17*a*, as shown in FIG. 3, and a protruding state protruding from the holes 16*a*, 17*a* (see FIG. 19).

Switching of the guide claws 16, 17 is, for example, achieved by a drive force of a guide claw drive actuator 36 (FIG. 23) including a solenoid. Here, when driven by the guide claw drive actuator 36, the guide claws 16, 17 protrude, and when the driving force is stopped, a biasing force of a tension spring (not illustrated) returns the guide claws 16, 17 to the retracted state.

2. Configuration of Stapler 103

As shown in FIG. 3, the stapler 103 is located at an end of the pivot tray 22 at the device back side and sheet transport direction downstream side of the pivot tray 22, and is provided with a stapling portion 111 and a staple receiving portion 112 separated by an interval in a vertical direction.

Stapling is performed when an end portion (corner portion) of a sheet stack stacked on the pivot tray 22*a* is between the stapling portion 111 and the staple receiving portion 112, the corner portion being at a device back side and a sheet transport direction leading end side of the sheet stack. The stapling portion 111 lowers towards the staple receiving portion 112 to sandwich the corner portion of the sheet stack between the stapling portion 111 and the staple receiving portion 112 and, in a state in which a lower portion of the stapling portion 111 is pressed against a topmost sheet of the sheet stack, a staple is stapled into the sheet stack.

The sheet stack Sb that has been stapled by the stapler 103 is transported to a transport position for transport from the first storage portion 101 to the second storage portion 102.

3. Configuration of Second Storage Portion 102

The second storage portion 102 includes the front tray 51 and pressing claws 52.

(1) Front Tray

The front tray 51 (second tray) is located farther towards the device front side than the post-processing tray 11 of the first storage portion 101 and stores sheets transported from the post-processing tray 11 towards the device front side.

The front tray 51 has a sheet stacking surface 51*a* that inclines downwards from the device front side towards the device back side and a wall portion 51*b* upright in a vertical direction at an end portion of a device back side of the sheet stacking surface 51*a*.

The front tray 51, in a state in which the sheet post-processing device 2 is mounted on the image forming apparatus 1 and when viewed from the device front side, is lined up in the device lateral direction with the operation unit 5 (FIG. 1) and an end 51*d* of the device front side of the front tray 51 is positioned farther towards the device front side in the device front-back direction than an end 3*a* of a device front side of the scanner 3.

Further, as shown in FIG. 3, length of the front tray 51 in the device lateral direction is approximately identical to length of the pivot tray 22 of the first storage portion 101 in the device lateral direction.

(2) Pressing Claws

Figure 22:
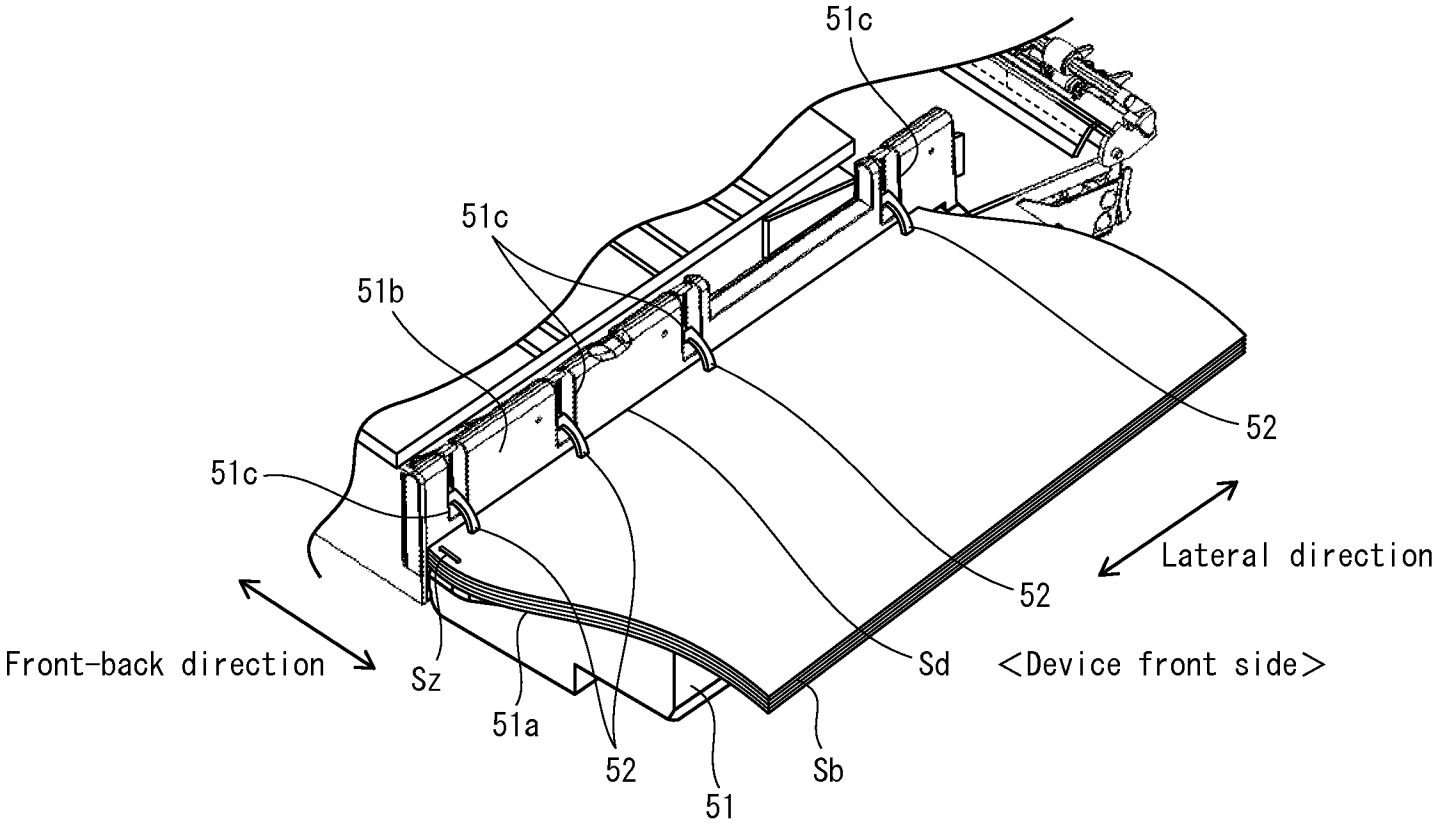
FIG. 22 is a partial perspective view showing a state in which the sheet stack that has been transported from the pivot tray is stored on a front tray.

The pressing claws 52 are each located in a corresponding one of four cutout portions 51*c* provided in the wall portion 51*b* along the device lateral direction with intervals therebetween. The pressing claws 52 are supported to be switchable from a retracted position, as shown in FIG. 3, and a protruding position protruding from the wall portion 51*b* that is described later (FIG. 22). By switching to the protruding position, the pressing claws 52 press on a sheet stored on the front tray 51, holding the sheet so as to prevent the sheet rising.

Operation of Sheet Post-Processing Device

The following describes in detail operation of each element of the sheet post-processing device 2 having the basic configuration described above, from N of the sheets S being ejected from the image forming device 1 to performing stapling to transport to the front tray 51. In the present embodiment, N is a number (stapling sheet number) of the sheets S making up one sheet stack (one set).

1. Alignment Operation

When a first sheet is transported in to the sheet post-processing device 2 from the image forming device 1 via the ejection roller 7, the first sheet is guided to the post-processing tray 11 via the holding guides 19*a*, 19*b*, and until a transport direction rear end of the first sheet passes through the ejection roller 7, the first sheet is transported in the sheet transport direction on the post-processing tray 11 by the drive power of the ejection roller 7.

The transport direction rear end of the first sheet passes through the ejection roller 7 and is stacked on the post-processing tray 11.

FIG. 4 is a schematic perspective view showing a state in which a first one of the sheets S is stacked on the post-processing tray 11.

Before one of the sheets S is stacked on the post-processing tray 11, the CD reference plate 12 and the CD reference plate 29 move from their respective home positions to reference positions indicated in the drawing. When the one of the sheets S is stacked on the post-processing tray 11, FD alignment is to be performed and the FD alignment member 14 moves in the Y direction indicated by the arrow from its home position to an FD alignment position in accordance with sheet size of the sheets S.

A position separated from the stoppers 18*a*, 18*b* by a transport direction length (sheet length) L of the sheets S in the sheet transport direction corresponds to the FD alignment position, and setting of the FD alignment position is performed by acquiring sheet information indicating size of the sheets S (A4, etc.) and transport orientation (longitudinal or transverse) from the image forming device 1.

Here, a longitudinal transport orientation of the sheets S is an orientation in which the sheets S are transported while, among long edges and short edges of the sheets S, the long edges are oriented along the sheet transport direction (longitudinal paper feed), and a transverse transport orientation of the sheets S is an orientation in which the sheets S are transported while the short edges are oriented along the sheet transport direction (transverse paper feed).

The post-processing tray 11 is inclined downwards towards a sheet transport direction upstream side thereof, and therefore the sheets S ejected onto the post-processing tray 11 slide towards the stoppers 18*a*, 18*b* on the sheet stacking surface of the post-processing tray 11. Further, the FD alignment member 14 is moved to the FD alignment position and the sheets S on the post-processing tray 11 are pushed by the FD alignment member 14 in the Y direction indicated by the arrow so that a transport direction leading end Sf of the sheets S is in contact with the FD alignment member 14 while a transport direction rear end Se of the sheets S is reliably in contact with the stoppers 18*a*, 18*b*.

In this way, the sheets S on the post-processing tray 11 are aligned in the sheet transport direction using the position of the stoppers 18*a*, 18*b* as a reference (FD alignment).

When FD alignment is complete, CD alignment is to be performed, and the CD alignment plate 13 moves from its home position to a CD alignment position, according to the sheet size of the sheets S, in an A direction indicated by an arrow (direction towards the device back side).

The CD alignment position corresponds to a position separated from the CD reference plate 12 by a width W (sheet width) in a width direction of the sheets S in the device front-back direction. Determining the CD alignment position is performed by acquiring sheet information from the image forming device 1.

By moving the CD alignment plate 13 to the CD alignment position, the sheets S on the post-processing tray 11 are pushed in the A direction indicated by the arrow so that a side edge Sc of one side of the sheets S is in contact with the CD alignment plate 13 while a side edge Sd of another side of the sheets S is in contact with the CD reference plate 12, 29. In this way, the sheets S on the post-processing tray 11 are aligned in the device front-back direction using the position of the CD reference plate 12, 29 as a reference (CD alignment).

When the FD alignment of the first of the sheets S is completed, the FD alignment member 14 returns from the FD alignment position to a position a predefined distance from the FD alignment position (for example, 10 mm) and waits, and when the CD alignment is completed, the CD alignment plate 13 returns from the CD alignment position to a position a predefined distance from the CD alignment position (for example, 10 mm) and waits, each waiting for a second one of the sheets S to be transported in from the image forming device 1 to the post-processing tray 11.

When the second one of the sheets S is transported in, onto the post-processing tray 11, the FD alignment and the CD alignment described above is performed while the second one of the sheets S is in a state in which it is stacked on the first one of the sheets S which has already been aligned. FD alignment and CD alignment is repeated each time one of the sheets S is transported in to the post-processing tray 11 until transport in of N of the sheets S is completed. In this way, a plurality of the sheets S are stacked on the post-processing tray 11 in a state in which the sheets S are aligned.

2. Operation of Transport to Stapling Position (1) Summary

Figure 5:
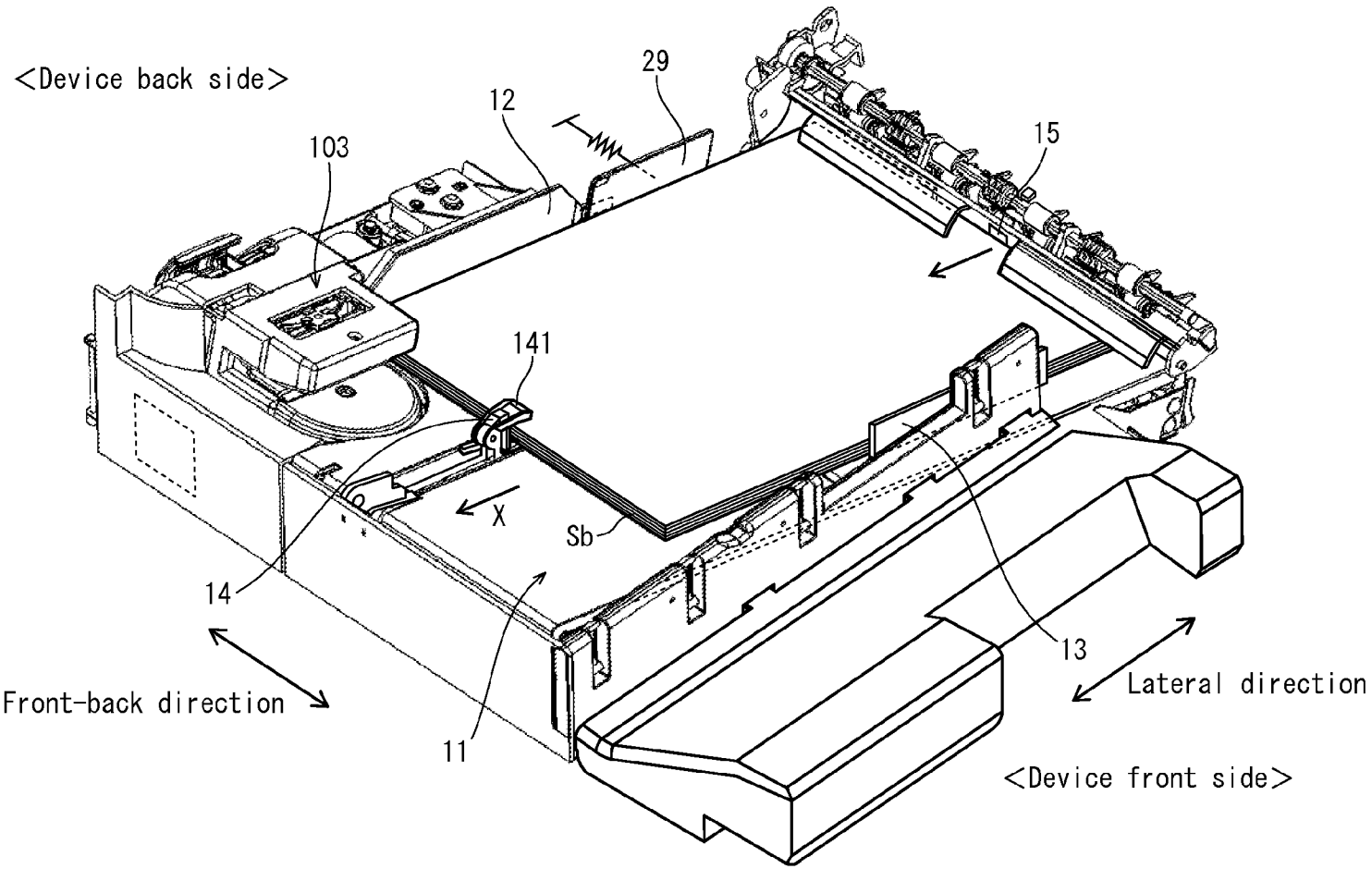
FIG. 5 is a schematic perspective view of a state in which a sheet stack that has been aligned is to be moved to a stapling position.

FIG. 5 is a schematic perspective view showing the sheet stack Sb, which is N of the sheets S in a stack, in a state in which the sheet stack Sb is aligned on the post-processing tray 11.

When alignment of all of N of the sheets S is complete, the sheet stack Sb is moved in the X direction indicated by the arrow (the sheet transport direction) in a way that does not lose alignment of the sheet stack Sb.

Figure 6:
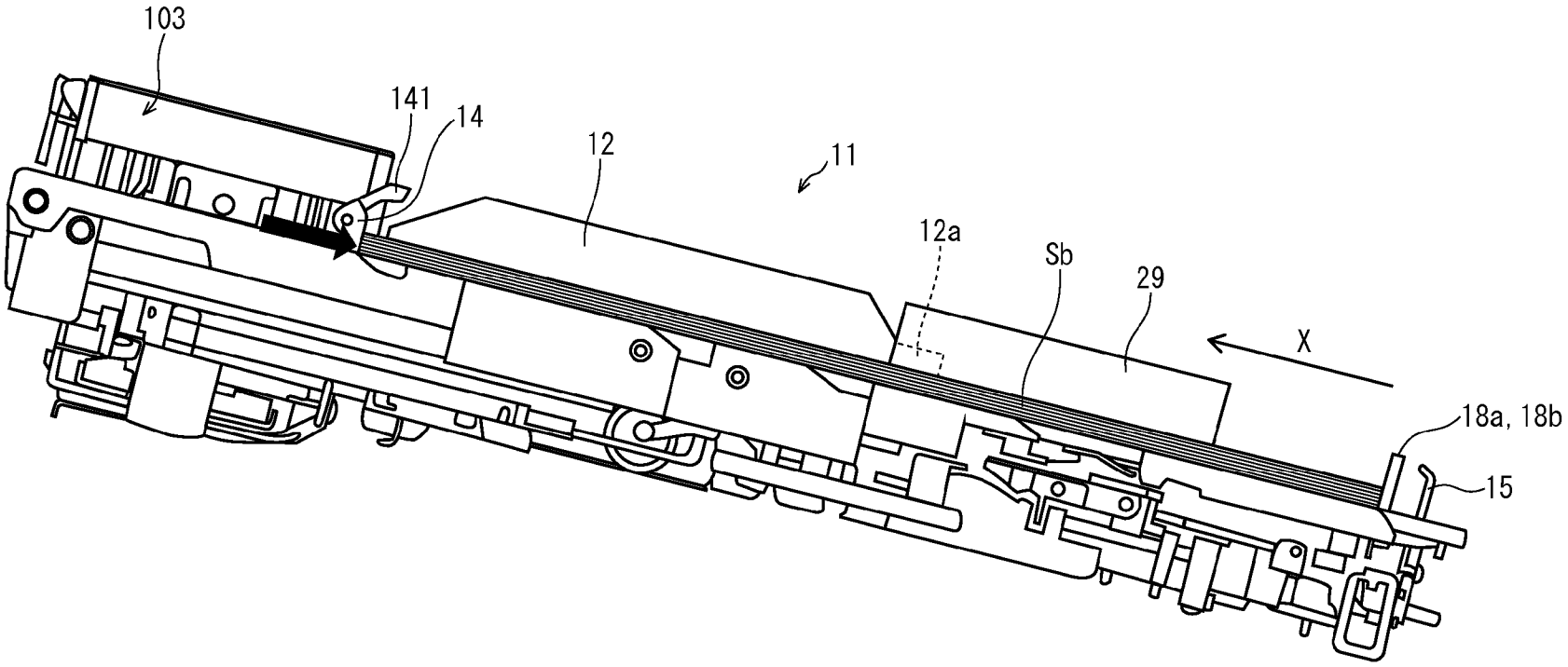
FIG. 6 is a schematic cross-section view of a post-processing tray for describing a state in which an FD alignment member is moved to FD align the sheet stack.
Figure 7:
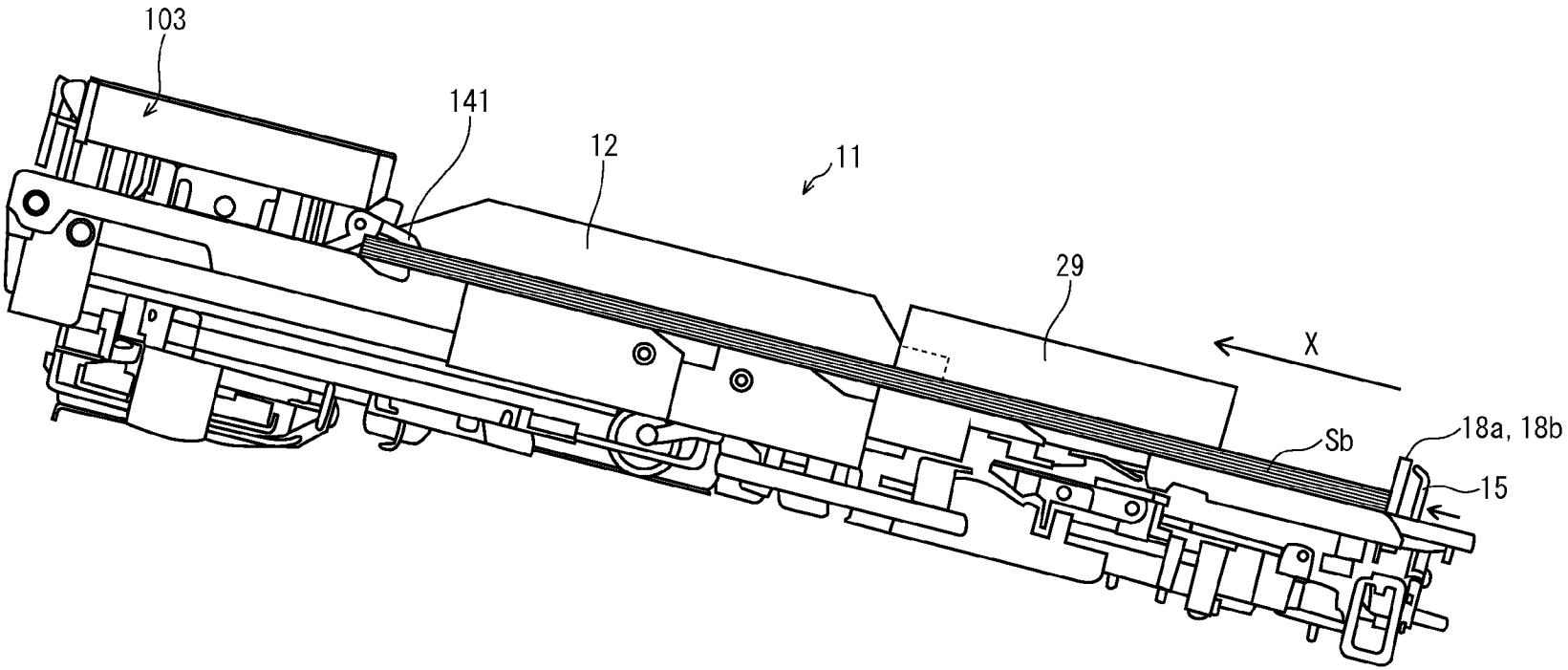
FIG. 7 is a schematic cross-section view of the post-processing tray for describing a state in which a gripping claw of the FD alignment member grips a leading end portion of the sheet stack.
Figure 8:
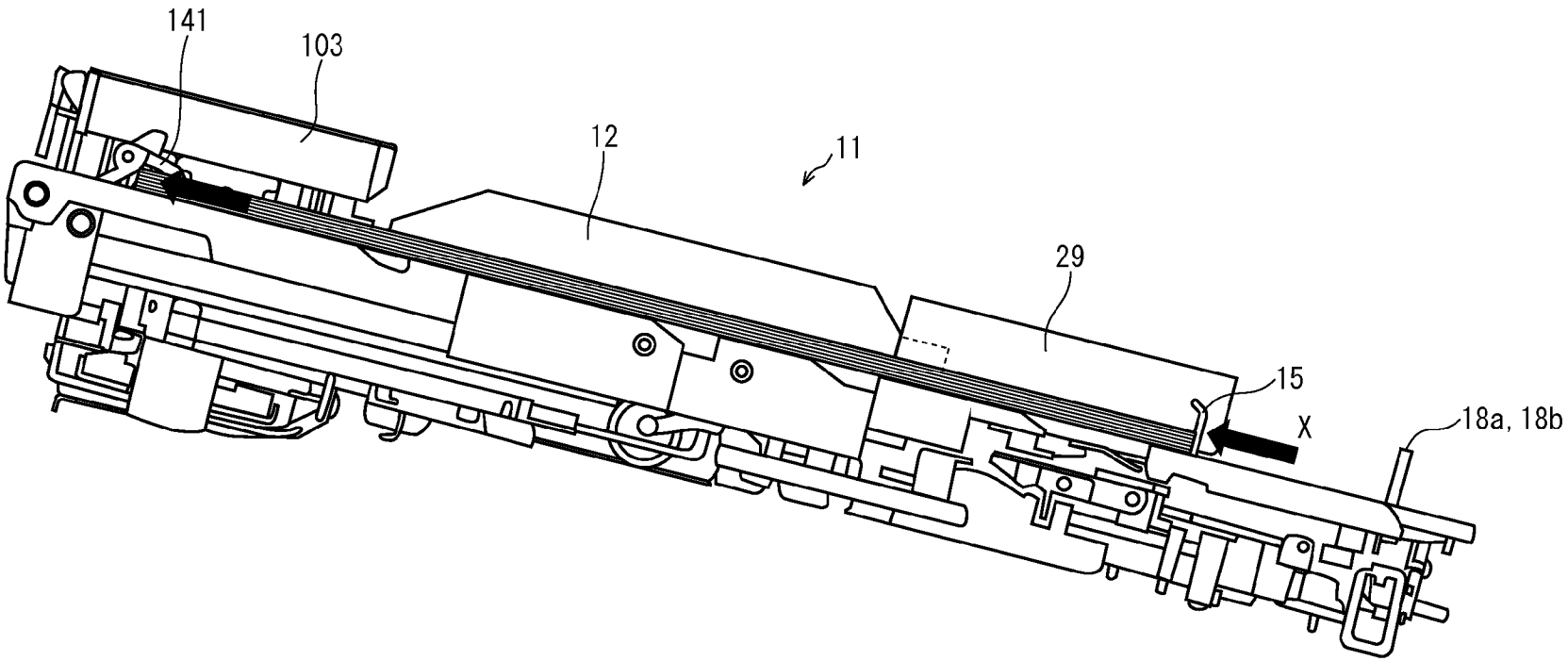
FIG. 8 is a schematic cross-section view of the post-processing tray for describing a state in which the FD alignment member grips the leading end portion of the sheet stack by using the gripping claw and the sheet stack is moved toward a stapler according to an FD transport member.

FIG. 6 to FIG. 8 are schematic cross-sections along the X direction of the post-processing tray 11 and show states from FD alignment to the sheet stack Sb being transported to the stapling position.

FIG. 6 shows a state in which the FD alignment member 14 immediately after FD alignment of an Nth sheet is in contact with the leading end portion of the sheet stack Sb. In this state, the sheet stack Sb is aligned in the FD direction by the stoppers 18*a*, 18*b* and the FD alignment member 14.

When the sheet stack Sb is to be transported to the stapling position and the FD transport member 15 is moved in the X direction, the gripping claw 141 of the FD alignment member 14 closes and grips the leading end portion of the sheet stack Sb as indicated in FIG. 7, according to an inter-dependent mechanism described later.

When the FD transport member 15 has moved far enough to contact the rear end of the sheet stack Sb, the FD alignment member 14 is caused to move in synchronization with the FD transport member 15 at an identical speed in the X direction. The sheet stack Sb, which is guided by both the CD reference plate 12, 29 and the CD alignment plate 13, is moved along the X direction indicated by the arrow to the stapling position of the stapler 103, whereupon movement of the FD alignment member 14 and the FD transport member 15 is stopped (FIG. 8).

Movement distance of the FD alignment member 14 and the FD transport member 15 for transporting the sheet stack Sb to the stapling position is determined by referring to staple position information associated in advance with sheet size and movement distance stored in a memory of the controller 104.

In this way, the sheet stack Sb is transported by both the FD alignment member 14 and the FD transport member 15 while the leading end portion of the sheet stack Sb is gripped by the gripping claw 141, and therefore stapling can be performed on the sheet stack Sb, which has been aligned, without loss of alignment, and particularly without loss of alignment of the leading end portion.

This gripping operation by the gripping claw 141 of the FD alignment member 14 can easily be performed by mounting a well-known actuator such as a solenoid or cam mechanism on the FD alignment member 14, but in the present embodiment, the gripping claw 141 is automatically closed by an inter-dependent mechanism that is mechanically inter-dependent with movement of the FD transport member 15 (hereafter, "gripping inter-dependent mechanism").

(2) Configuration of Gripping Inter-Dependent Mechanism

The following describes the gripping inter-dependent mechanism, based on FIGS. 9-16.

First, FIG. 9 shows a belt drive mechanism for moving the FD alignment member 14 and the FD transport member 15 in the sheet transport direction (the X direction).

A base 151 of the FD transport member 15 is supported to be slidable in the X direction along two guide rails 152, 153. Using the motor M1 as a drive source, a belt drive mechanism 154 composed of pulleys and belts follows rotational movement of a drive belt 155 to enable back-and-forth movement of the FD transport member 15 in the X direction.

Further, a base 142 of the FD alignment member 14 is supported to be slidable in the X direction along two guide rails 143, 144. Using the motor M3 as a drive source, a belt drive mechanism 145 follows rotational movement of a drive belt 146 to enable back-and-forth movement of the FD alignment member 14 in the X direction.

Figure 10:
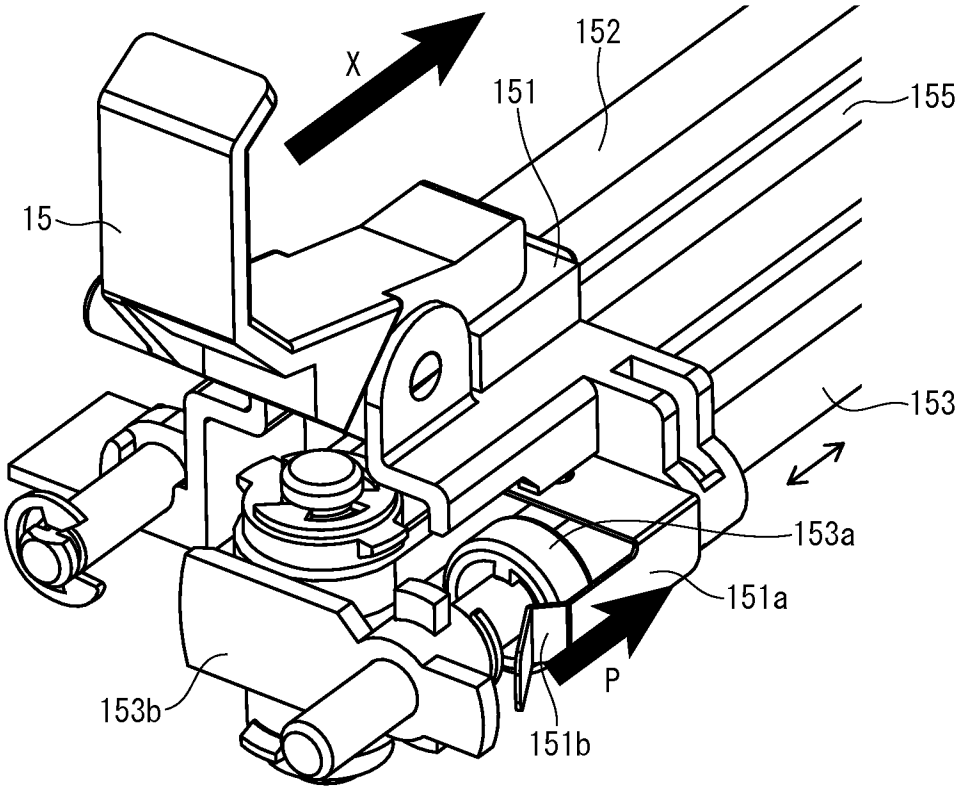
FIG. 10 is a partial perspective view for describing a state in which, during movement of the FD transport member, an engaging member of a base of the FD transport member is caused to contact an engagement ring of a guide rail and move the guide rail in a P direction indicated by an arrow.

FIG. 10 is an enlarged perspective view of the FD transport member 15 at its home position (see FIG. 6, a position slightly farther back than the stoppers 18*a*, 18*b* upstream in the sheet transport direction).

Of the two guide rails 152, 153, the guide rail 153 is supported to be slidable only a predetermined amount in the X direction by a frame 153*b*, etc. An engaging member 151*a* composed of elastic material such as a spring plate attached to the base 151 of the FD transport member 15 has a bent portion 151*b*. The bent portion 151*b* engages with a ring member 153*a* that is fixed to the guide rail 153.

Thus, when the FD transport member 15 moves in the X direction, the guide rail 153 follows, also moving in a P direction indicated by an arrow.

Figure 11:
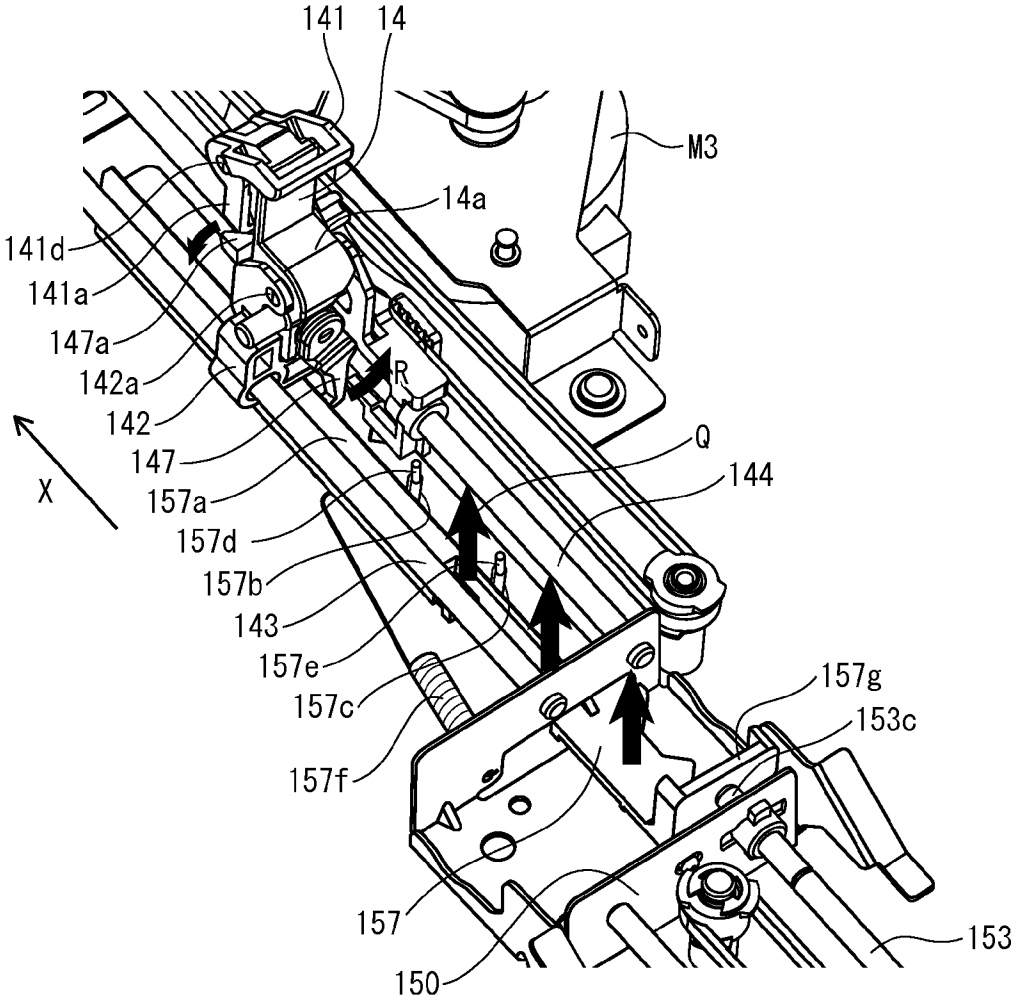
FIG. 11 is a perspective view showing a state in which, according to movement of the guide rail, a slide member moves in a Q direction and a lever member moves in an R direction to put the gripping claw of the FD alignment member in a closed state.

As shown in FIG. 11, a sheet transport direction leading end portion 153*c* of the guiding rail 153 is in contact with an end portion 157*g*, bent in a vertical direction, of a slide member 157 located below the guide rails 143, 144. The slide member 157 is pushed in the X direction by movement of the guide rail 153 in the P direction.

The slide member 157 has elongated holes 157*b*, 157*c* that form a predefined angle with respect to the X direction. A frame (not illustrated) of the sheet post-processing device 2 is provided with engaging pins 157*d*, 157*e*. The engaging pins 157*d*, 157*e* are engaged with the elongated holes 157*b*, 157*c*. The slide member 157 is biased in a direction opposite the X direction by a tension spring 157*f*.

When the end portion 157*g* of the slide member 157 is pushed in the X direction by an end portion 153*c* of the guide rail 153, the slide member 157 moves parallel to a Q direction, along a direction of elongation of the elongated holes 157*b*, 157*c*.

Figure 12:
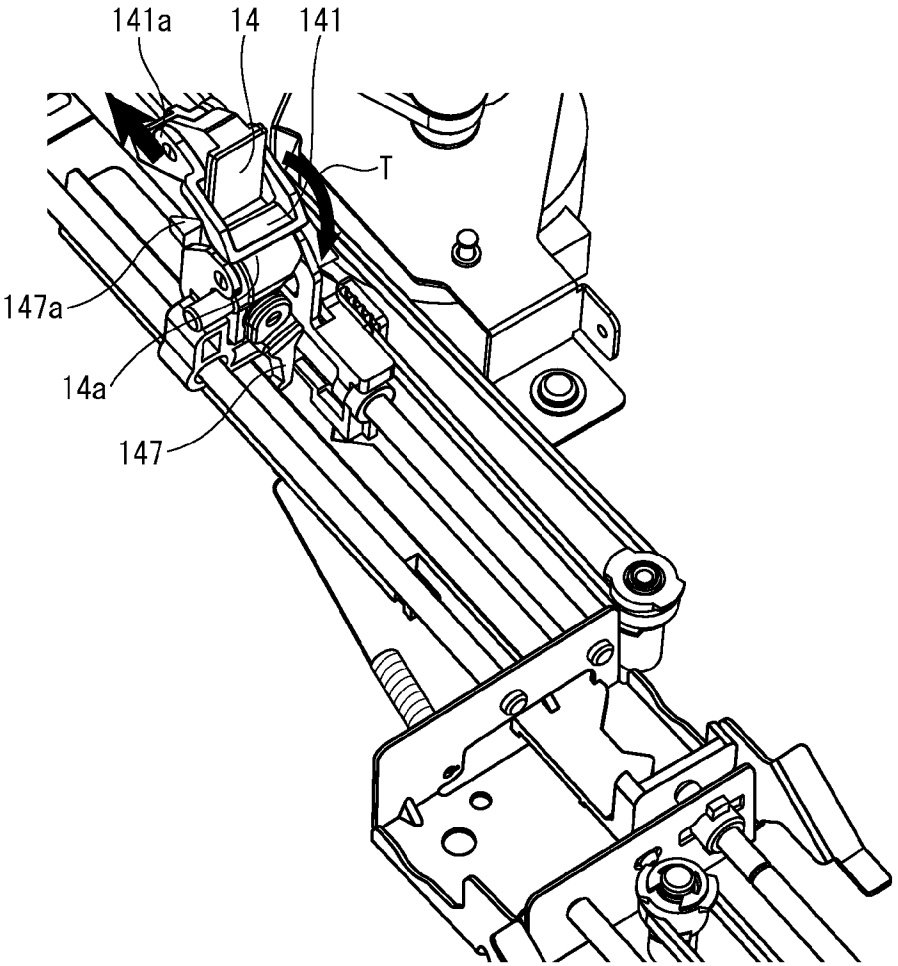
FIG. 12 is a perspective view showing the lever member moved farther, releasing a lock of the gripping claw to put the gripping claw in a closed state.

On the other hand, the FD alignment member 14 is supported to be tiltable in the X direction by a support shaft 142*a* with respect to the base 142 (see FIG. 16, described later), and the gripping claw 141 of an upper portion of the FD alignment member 14 is supported to be pivotable in a direction opposite the X direction (a T direction in FIG. 12).

A torsion spring 141*c* (see FIG. 13) is attached to a portion of a support shaft 141*d* of the gripping claw 141, biasing the gripping claw 141 to rotate in a direction to close the gripping claw 141 to grip the sheet stack Sb. However, at a stage shown in FIG. 11, a restriction member 147*a* is engaged with an engaging lever 141*a* of the gripping claw 141, preventing the gripping operation of the gripping claw 141.

The restriction member 147*a* is fixed to an axial member passing through the FD alignment member 14 in the X direction and a base portion of a lever member 147 is fixed to an end portion of an FD transport member 15 side of the axial member.

A step portion 157*a* is formed on the slide member 157 along a longitudinal direction (the X direction) of the slide member 157. The step portion 157*a* is in contact with a lower end portion of the lever member 147 of the FD alignment member 14.

Thus, when the slide member 157 attempts to move obliquely in the Q direction due to pushing from the guide rail 153, a force occurs causing the lower end portion of the lever member 147 to rotate in an R direction indicated by an arrow in FIG. 11 due to the step portion 157*a* of the slide member 157. Along with this rotation, the restriction member 147*a* falls over to a left side, removing restriction from the engaging lever 141*a* of the gripping claw 141. As shown in FIG. 12, the gripping claw 141 falls forward due to a biasing force of the torsion spring 141*c* (FIG. 13), clamping the sheet stack Sb between the gripping claw 141 and the horizontal portion 14*a* of the FD alignment member 14.

The step portion 157*a* of the slide member 157 is extended in the X direction, and therefore, even if the position of FD alignment is moved according to size of the sheets S in the X direction, the step portion 157*a* is normally engaged with the lower end portion of the lever member 147 and can cause the gripping claw 141 to close.

When the slide member 157 moves a distance of length in the X direction of the elongated holes 157*b*, 157*c*, the gripping claw 141 is in the gripping state, the slide member 157 cannot move farther in the X direction, and movement of the guide rail 153 is stopped.

Thus, in response to movement of the FD transport member 15, the bent portion 151*b* of the engaging member 151*a* formed from elastic material (FIG. 10) is pushed outward, releasing engagement between the bent portion 151*b* and the ring member 153*a* of the guide rail 153, and the FD transport member 15 proceeds to slide along the guide rails 152, 153 in the X direction.

As shown in FIG. 11, the slide member 157 is biased in a direction opposite the X direction by the tension spring 157*f*, and therefore the slide member 157 returns the guide rail 153 to its initial position due to the engagement of the bent portion 151*b* and the ring member 153*a* of the guide rail 153 being released as described above.

In this way the lever member 147 also returns to its initial position according to an elastic body (not illustrated) such as a torsion spring.

The gripping operation of the gripping claw 141 described above is preferably determined by form, dimensions, and positional relationships of the engaging member 151*a*, the slide member 157, the lever member 147, and the restriction member 147*b* to complete either immediately before or at least by a time the FD transport member 15 contacts the rear end of the sheet stack Sb due to movement of the FD transport member 15 from its home position in the X direction.

When the FD transport member 15 contacts the rear end of the sheet stack Sb, the motor M3 begins rotation, causing the FD alignment member 14 gripping the leading end of the sheet stack Sb to move in the X direction at an identical speed to movement speed of the FD transport member 15.

Thus, the sheet stack Sb can be transported to the stapling position while alignment of the leading end portion of the sheet stack Sb is maintained.

3. Stapling Operation

Figure 18:
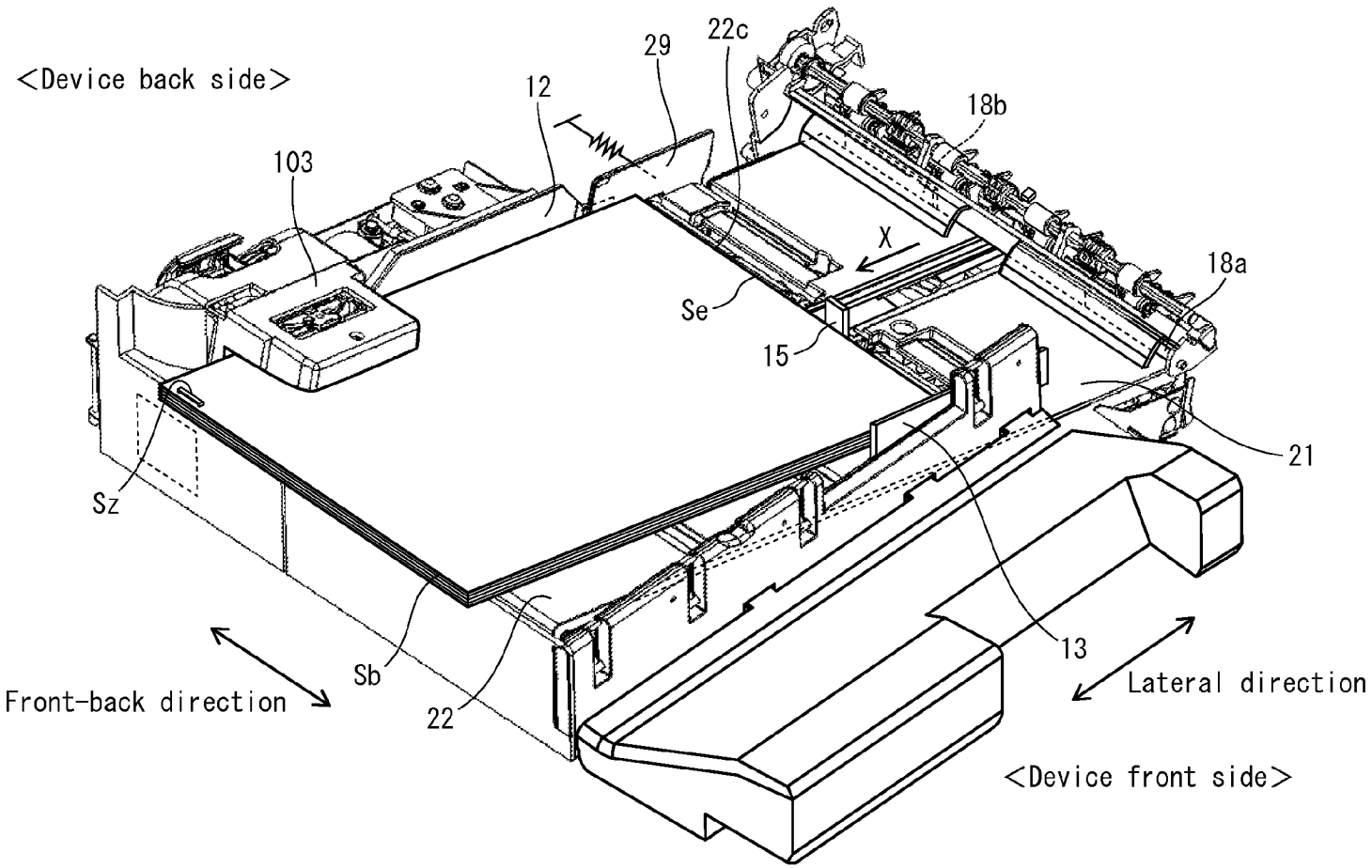
FIG. 18 is a perspective view showing a state in which the sheet stack after stapling processing is moved farther to a transport position by the FD transport member.

When the sheet stack Sb arrives at the stapling position, movement of the FD transport member 15 and the FD alignment member 14 simultaneously stops, and stapling is performed by the stapler 103 using a staple Sz (see FIG. 18).

4. Grip Release of the Gripping Claw 141 and Retraction Operation of the FD Alignment Member 14

After stapling, the FD transport member 15 and the FD alignment member 14 are synchronized to move to perform an operation transporting the sheet stack Sb farther downstream in the transport direction. However, in the present embodiment, length of the post-processing tray 11 in the X direction is limited because the sheet post-processing device is compact, and therefore the gripping claw 141 releases the sheet stack Sb part-way through the operation, the FD alignment member 14 retracts below the sheet stacking surface, and subsequently the sheet stack Sb is transported only by the FD transport member 15.

Figure 13:
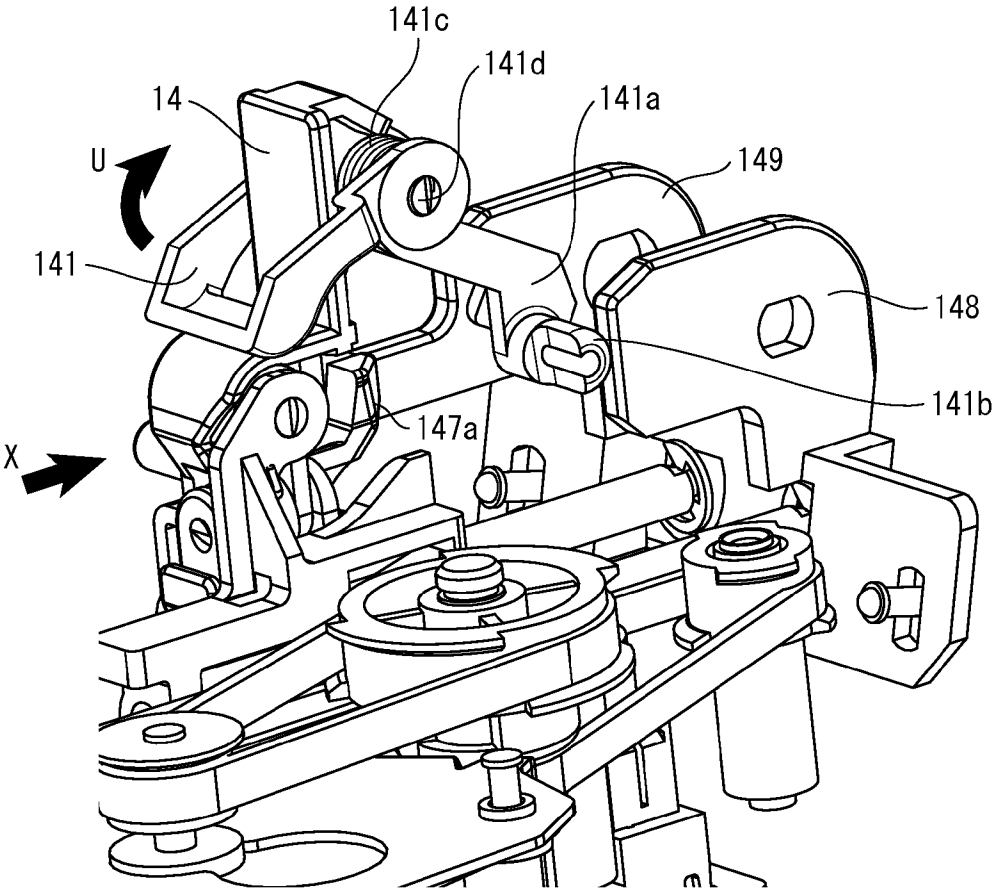
FIG. 13 is a perspective view showing a state in which the FD alignment member moves to a sheet transport direction end, causing an engagement pin of the gripping claw to contact a guide plate and start to release a grip.
Figure 14:
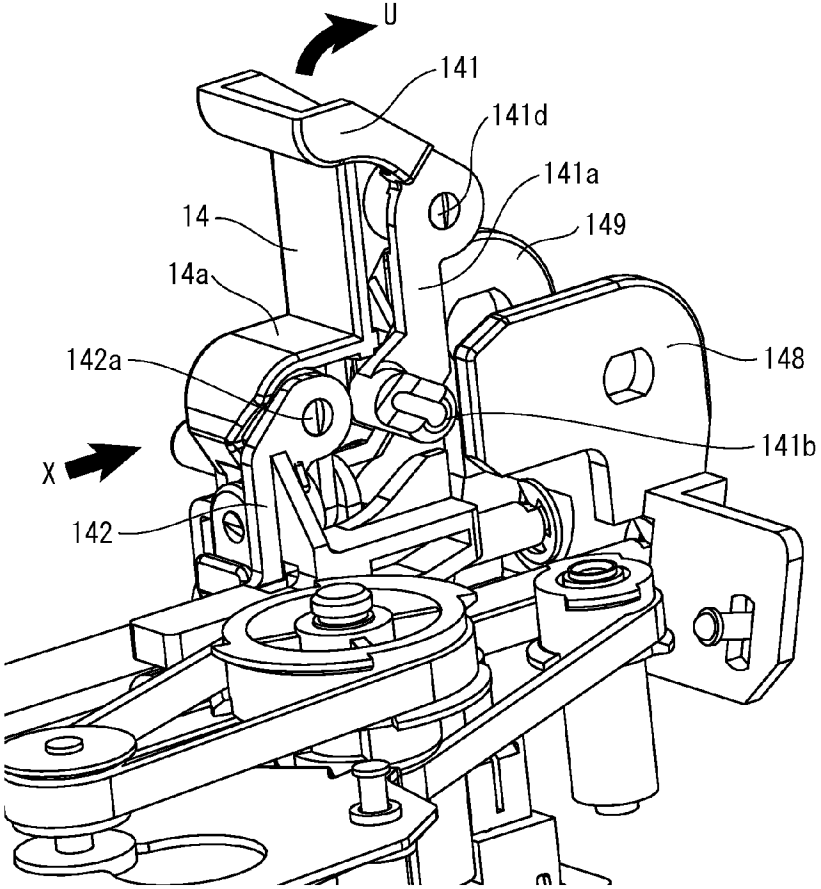
FIG. 14 is a perspective view showing a state in which the FD alignment member moves farther, causing the gripping claw of the FD alignment member to become fully open.

Specifically, after stapling, when the FD alignment member 14 moves downstream in the transport direction, an engagement pin 141*b* provided to a restriction lever 141*a* of the gripping claw 141 contacts an end portion of the guide plate 148, as shown in FIG. 13, to rotate the gripping claw 141 in a U direction indicated by an arrow, against the biasing force of the torsion spring 141*c*, completely opening up the gripping claw 141 to release the gripped state of the sheet stack Sb as shown in FIG. 14.

A tapered surface on an X direction side of the restriction member 147*a* is tapered, and, along with the opening up of the gripping claw 141, the restriction lever 141*a* contacts the tapered surface of the restriction member 147*a*, pushing over the restriction member 147*a* in a direction of an arrow in FIG. 11. When the restriction lever 141*a* returns to its initial vertical state the restriction member 147*a* returns to its original position, and the gripping claw 141 is again locked in place.

In order to simplify FIG. 13 and FIG. 14, the sheet stack Sb is not shown.

Figure 15:
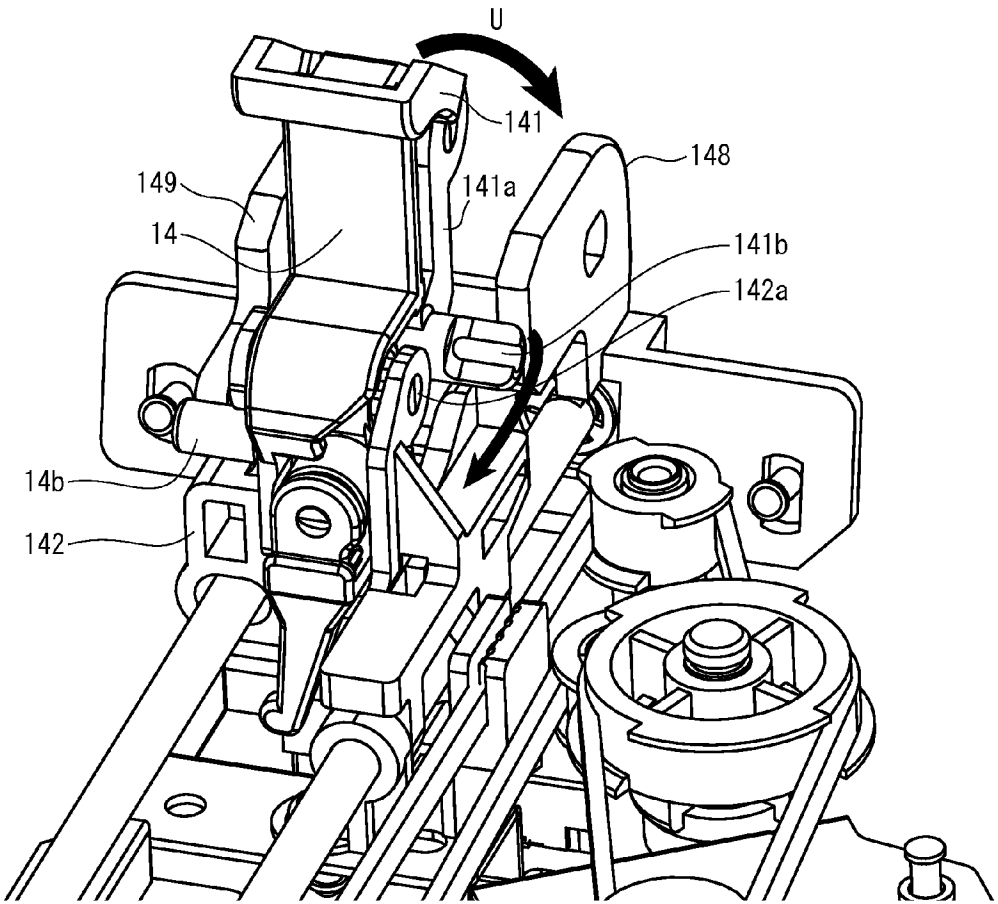
FIG. 15 is a perspective view showing a moment at which the FD alignment member moves farther, causing the engagement pin of the FD alignment member to contact the guide plate, causing the FD alignment member to move as if to fall over backwards.
Figure 16:
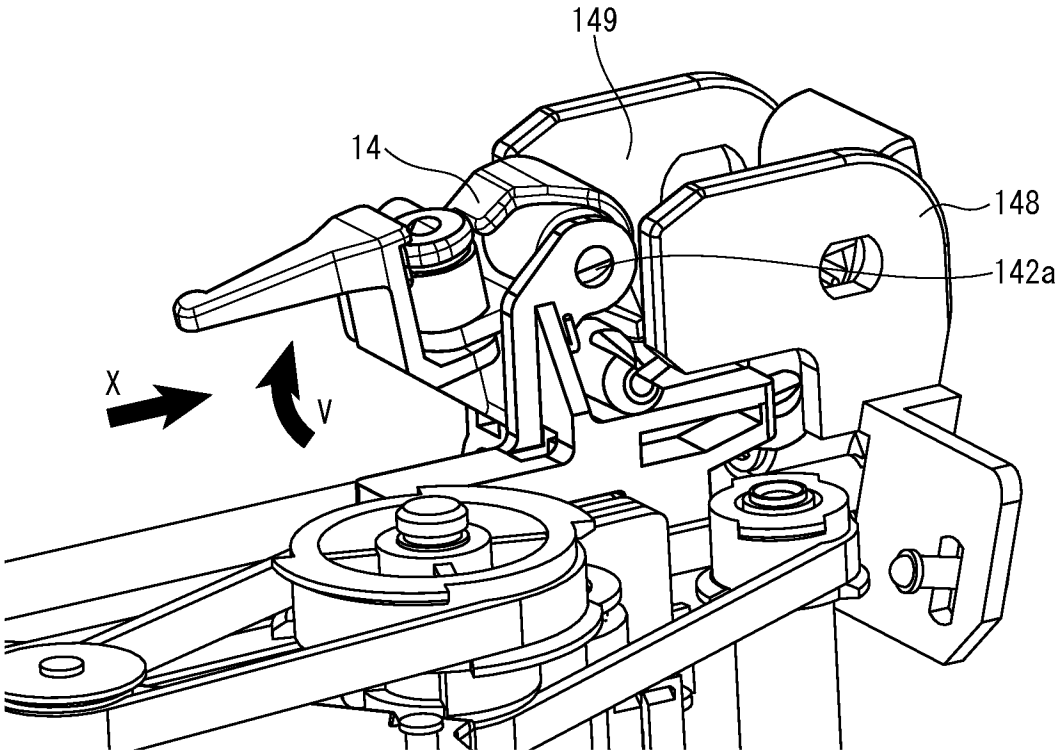
FIG. 16 is a perspective view showing a state in which the FD alignment member has completed the motion of falling over backwards, retracting under a sheet mounting surface.
Figure 17:
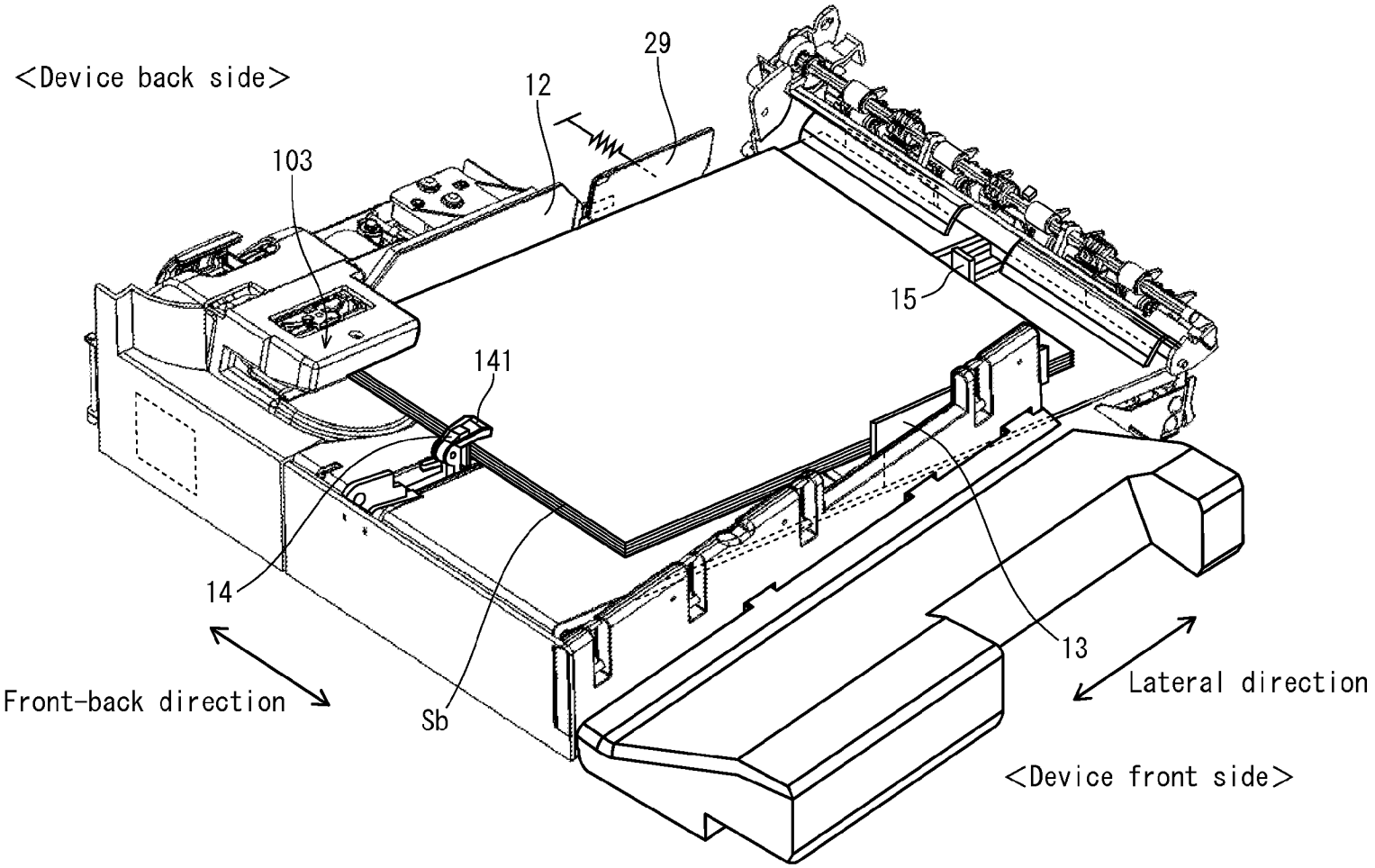
FIG. 17 is a perspective view showing a state in which the sheet stack has been moved to a stapling position by the FD alignment member and the FD transport member, and is stationary.

Further, as shown in FIG. 14, the FD alignment member 14 is supported by the support shaft 142*a* to be pivotable in a direction behind the base 142. The FD alignment member 14 is biased by a torsion spring (not shown) and is in contact with a stopper (not shown) in order to maintain an upright state. However, when the FD alignment member 14 moves farther downstream in the sheet transport direction, an engagement pin 14*b* provided on the FD alignment member 14 contacts a leading end portion of a guide plate 149, as shown in FIG. 15, guiding the FD alignment member 14 to fall over backwards, causing the FD alignment member 14 and the gripping claw 141 to enter a retracted state below the sheet stacking surface of the post-processing tray 11 (see home position in FIG. 3). At this timing, belt drive of the FD alignment member stops.

At this stage, the leading end portion of the sheet stack Sb is stapled by the staple Sz and therefore, even if not gripped by the gripping claw 141, alignment of the leading end portion of the sheet stack Sb is not lost.

Subsequently, as shown in FIG. 18, the FD transport member 15 moves further in the X direction indicated by the arrow, transporting the sheet stack Sb that is guided by both the CD reference plate 12, 29 and the CD alignment plate 13 to a position (transport position) at which a transportation direction rear end Se of the sheet stack Sb is a predefined distance downstream of the end 22*c* of the sheet transport direction upstream side of the pivot tray 22, at which point the FD transport member 15 is stopped.

The movement distance of the FD transport member 15 for transporting the sheet stack Sb to the transport position is determined based on a distance that is a magnitude of a difference between L1 and L2, (L1−L2), when a distance required for transporting the sheet stack Sb after alignment to the stapling position is L1 and a distance from the stoppers 18*a*, 18*b* to the rear end Se of the sheet stack Sb is L2. However, L1 is determined in advance according to a size of the sheets S and L2 is determined in advance, and therefore the movement distance of the FD transport member 15 can be specified when the size of the sheets S is known.

5. Pivot of Pivot Tray 22 to Horizontal State

According to the transport of the sheet stack Sb to the transport position, the sheet stack Sb is stacked entirely on the pivot tray 22.

Figure 19:
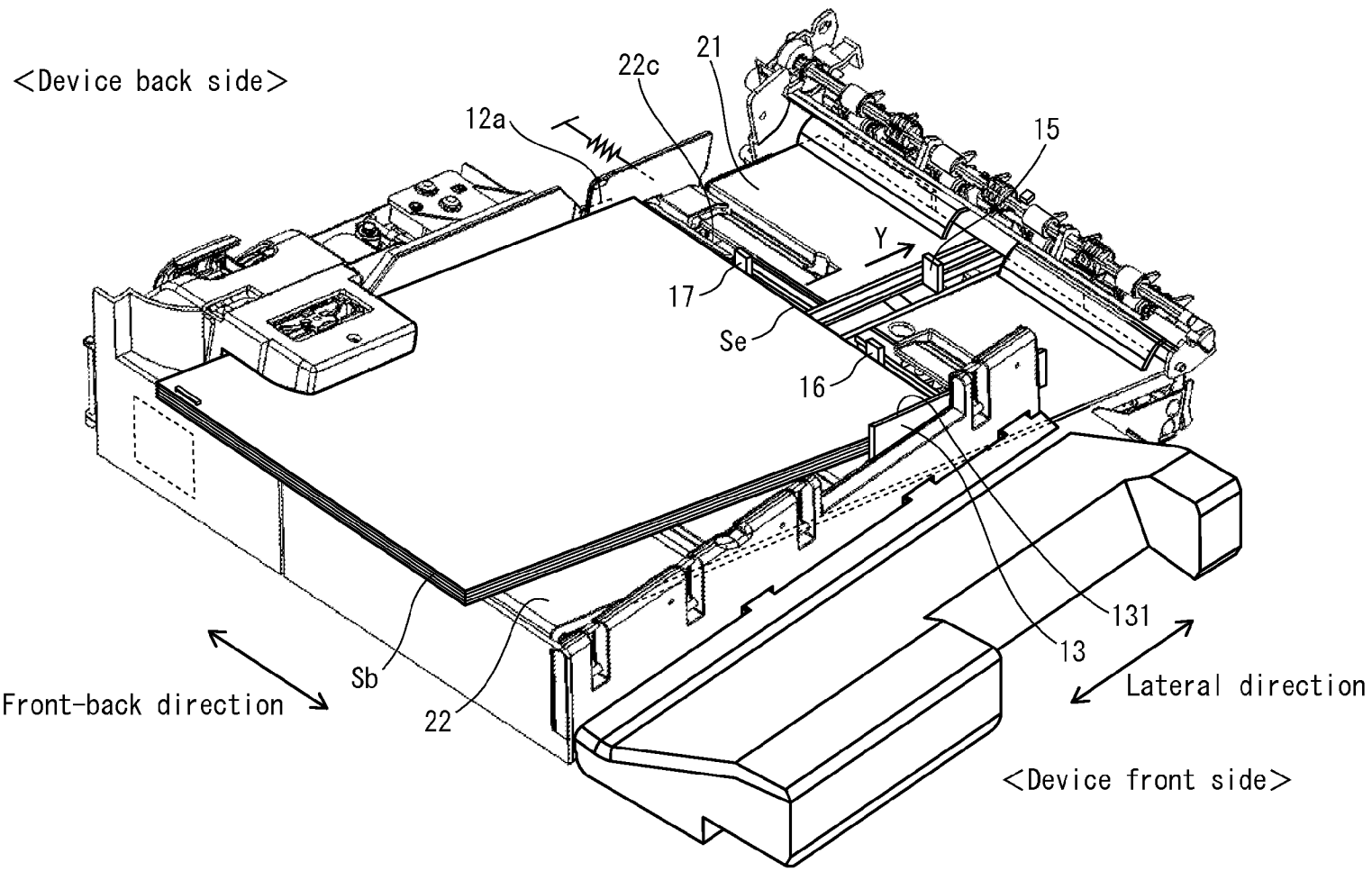
FIG. 19 is a perspective view showing a state in which two guide claws are switched to a protruding state.

When transport of the sheet stack Sb to the transport position is complete, as shown in FIG. 19, after the guide claws 16, 17 provided to the end 22*c* of the sheet transport direction upstream side of the pivot tray 22 switch to the protruding state, the FD transport member 15 moves in the Y direction indicated by the arrow to return to its home position and the engaging member 151*a* of the FD transport member 15 and the ring member 153*a* of the guide rail 153 return to an un-engaged state (FIG. 10).

A positional relationship between the guide claws 16, 17 when protruding, the rear end Se of the sheet stack Sb when positioned at the transport position, and the end 22*c* of the pivot tray 22 is that the guide claws 16, 17 are between the rear end Se of the sheet stack Sb and the end 22*c* of the pivot tray 22.

When the FD transport member 15 moves in the Y direction indicated by the arrow, the sheet stack Sb stacked on the pivot tray 22 in the inclined orientation is inclined to slide towards the fixed tray 21 along the incline of the pivot tray 22. However, the sheet stack Sb remains stacked on the pivot tray 22 according to the guide claws 16, 17 in the protruding state restricting sliding.

Subsequently, when the CD alignment plate 13 moves to the device front side to perform an operation to return to its home position, the pivot tray 22 in the inclined orientation transitions to the horizontal orientation by raising the end 22*c* of the sheet transport direction upstream side of the pivot tray 22, around the support shaft 22*b* at an end of the sheet transport direction downstream side of the pivot tray 22, as shown in FIG. 20.

A positional relationship in the vertical direction is determined in advance so that all of the sheet stacking surface 22*a* at a side edge 22*g* of the device front side of the pivot tray 22 is positioned higher than an upper end 53 of the wall portion 51*b* of the second storage portion 102 when the pivot tray 22 achieves the horizontal orientation.

The CD reference plate 12, the stapler 103, and the guide claws 16, 17 move integrally with the pivot tray 22, but the CD alignment plate 13 and the CD reference plate 29 are supported by the fixed tray 21 and therefore do not move integrally with the pivot tray 22.

A relationship between a range of motion in the vertical direction of the pivot tray 22 and vertical height of the CD alignment plate 13 is determined in advance so that an upper end 131 of the CD alignment plate 13 is positioned farther down in the vertical direction than the pivot tray 22 when the pivot tray 22 is in the horizontal orientation.

When the pivot tray 22 is in the inclined orientation, along the side edge 22*g* of the device front side of the pivot tray 22, an edge portion 22*m* (first side edge portion) that is an end portion of the side edge 22*g* downstream in the sheet transport direction is positioned higher than the upper end 53 of the wall portion 51*b* of the second storage portion 102 and an edge portion 22*n* (second side edge portion) that is another end portion of the side edge 22*g* upstream in the sheet transport direction is positioned lower than the upper end 53 of the wall portion 51*b* of the second storage portion 102.

When the pivot tray 22 is in the horizontal orientation, engagement between the CD reference plate 12 and the CD reference plate 29 is released and only the CD reference plate 29 returns to its home position according to the biasing force of the tension spring 28.

6. Transport Operation of the Front Tray 51

Figure 21:
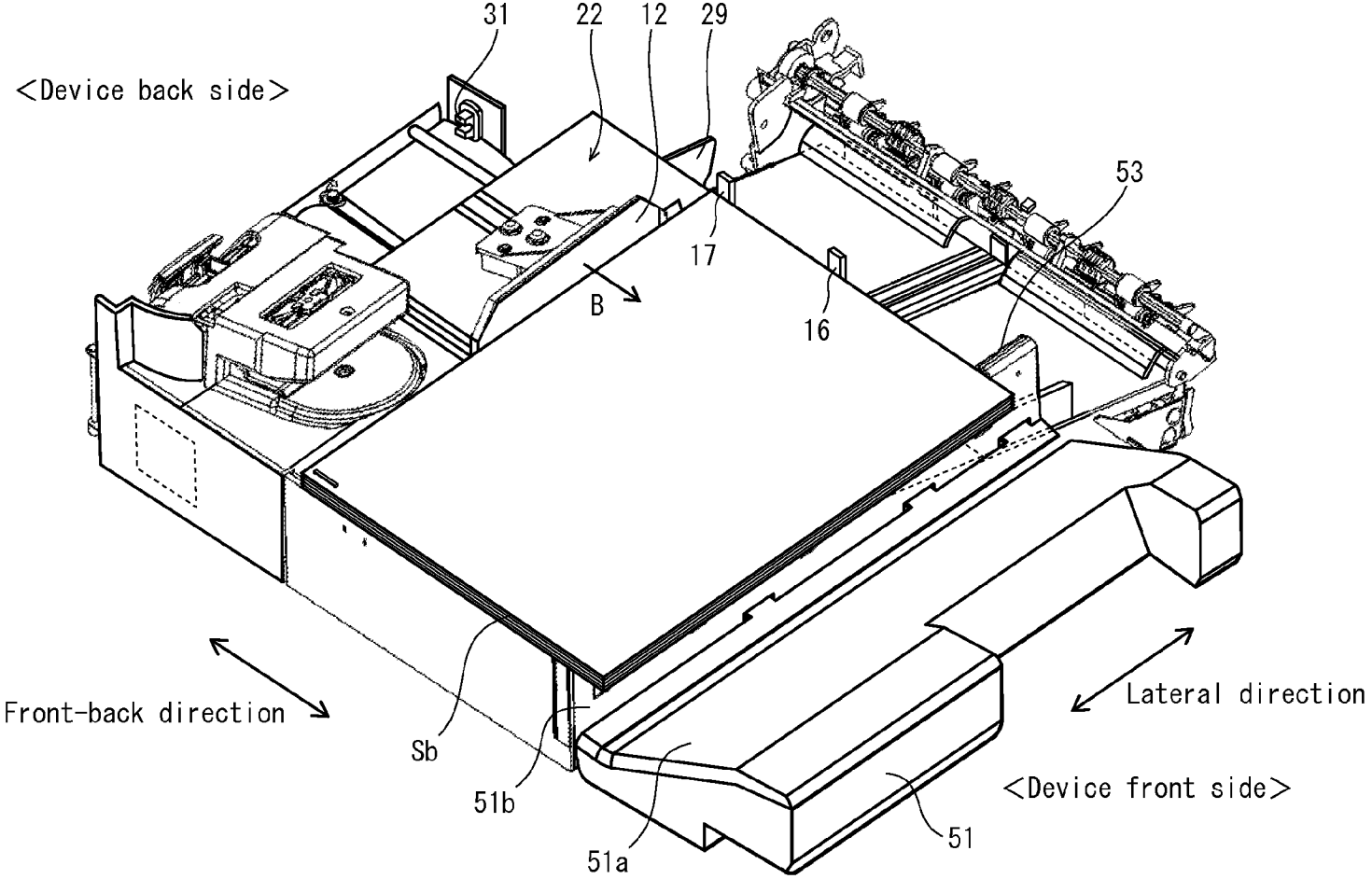
FIG. 21 is a perspective view showing a state in which the sheet stack on the pivot tray is being transported towards a device front side.

When transition of the pivot tray 22 to the horizontal orientation is complete, the CD reference plate 12 moves from the device back side towards the device front side in a direction B as shown in FIG. 21. In this way, the sheet stack Sb stacked on the pivot tray 22 in the horizontal orientation passes over the upper end 53 of the wall portion 51*b* and is transported towards the front tray 51 at the device front side.

When the pivot tray 22 is in the horizontal orientation, the pivot tray 22 is positioned higher than the CD alignment plate 13 and therefore transport of the sheet stack Sb towards the device front side is not hindered by the CD alignment plate 13.

When the CD reference plate 12 moves a full distance towards to the device front side, the sheet stack Sb on the pivot tray 22 in the horizontal orientation is transferred to the front tray 51 and stacked on the sheet stacking surface 51*a*, as shown in FIG. 22.

The sheet stack Sb stacked on the sheet stacking surface 51*a* of the front tray 51 slides towards the device back side along an incline of the sheet stacking surface 51*a*, but a side edge Sd (leading end in a slide direction) of a device back side of the sheet stack Sb contacts a wall portion 51*b* provided at the device back side of the front tray 51, restricting sliding of the sheet stack Sb.

In this way, the sheet stack Sb on the sheet stacking surface 51*a* is stationary in a state in which the side edge Sd of the device back side is in contact with the wall portion 51*b*. In this way, the wall portion 51*b* functions as a restrictor restricting the sheet stack Sb on the sheet stacking surface 51*a*.

It suffices that the sheet stack Sb on the pivot tray 22 in the horizontal orientation can be transported to the sheet stacking surface 51*a* of the front tray 51 without being hindered by the wall portion 51*b*, and therefore a positional relationship in of the sheet stacking surface 22*a* of the pivot tray 22 and the upper end 53 of the wall portion 51*b* may be such that, for example, the side edge 22*g* corresponding to the sheet stacking surface 22*a* and the upper end 53 of the wall portion 51*b* have the same position with respect to a positional relationship in the vertical direction.

Further, an orientation that allows transport of the sheet stack Sb (transport orientation) is not limited to the horizontal orientation and the pivot tray 22 may, for example, be configured such that the pivot tray 22 can achieve a forward incline orientation such that the device back side of the pivot tray 22 is higher than the side edge 22*g* of the device front side of the pivot tray 22. This configuration can be implemented by combining a mechanism performing a forward incline in the device front-back direction with a pivot mechanism in the vertical direction.

In a case in which a user specifies stapling multiple copies, a series of processes including alignment of the sheet stack Sb, stapling, transition of the pivot tray 22 to the horizontal position, and transport of the sheet stack Sb from the pivot tray 22 to the front tray 51 is executed for each copy sequentially.

In such a case, when a first copy of the sheet stack Sb is stored on the front tray 51 as illustrated in FIG. 22, the pressing claws 52 located in the cutout portions 51*c* protrude from the cutout portions 51*c* so that the first copy of the sheet stack Sb stored on the front tray 51 is in a held state of being pressed from above by the pressing claws 52.

The pressing claws 52 return to the retracted position (FIG. 3) immediately before a second copy of the sheet stack Sb arrives at the front tray 51. Protruding and retracting of the pressing claws 52 is, for example, achieved by a drive force of a pressing claw drive actuator 37 (FIG. 23) including a solenoid. When the pressing claw drive actuator 37 is driven and a leading end of the pressing claws 52 protrudes from the wall portion 51*b* to press against the sheet stack Sb, and the drive is stopped, biasing force of tension springs (not shown) return the pressing claws 52 to the retracted position.

When the second copy of the sheet stack Sb is transported to the front tray 51 and stacked on the first copy of the sheet stack Sb stored on the front tray 51, two stacked copies of the sheet stack Sb are once again put into a held state of being pressed down by the pressing claws 52. In a case in which stapling of copies of the sheet stack Sb continues, the above operations are repeated for each copy and when the job finishes, the pressing claws 52 are returned to the retracted position and the held state is released. When only one copy is to be stapled, after pressing of the sheet stack Sb by the pressing claws 52 is executed once, the pressing claws 52 are returned to the retracted position.

In this way, at least one of the sheet stack Sb that has been stapled is stored on the front tray 51 located on the device front side and a user can easily take the sheet stack Sb stored on the front tray 51 from the device front side.

When transport of the sheet stack Sb from the pivot tray 22 to the front tray 51 is completed, the CD reference plate 12 moves towards the device back side to return from the device front side to its home position. When the CD reference plate 12 returns to its home position, the pivot tray 22 descends to return to the inclined orientation.

When the CD reference plate 12 returns to its home position, the protrusion 12*a* of the CD reference plate 12 (FIG. 3) is positioned to be at the device back side of the CD reference plate 29. When the CD reference plate 12 is again moved towards the device front side, the protrusion 12*a* contacts the surface 29*a* of the device back side of the CD reference plate 29 to resume engagement of the CD reference plate 12 and the CD reference plate 29.

Above, an example is described of a case in which a job is executed for performing stapling of the sheet stack Sb. However, in a case in which, for example, a job is for printing a plurality of the sheets S without stapling, alignment of the sheet stack Sb, transport to the pivot tray 22, transition of the pivot tray 22 to the horizontal orientation, and transport to the front tray 51 is performed without stapling.

Further, for example, in a case in which a job is for printing a single one of the sheets S, the above alignment and processing without stapling, in other words transport to the pivot tray 22, transition of the pivot tray 22 to the horizontal orientation, and transport to the front tray 51, is performed.

Control Configuration of Image Forming Device 1 and Sheet Post-Processing Device 2

FIG. 23 is a block diagram for describing control configuration of each of the image forming device 1 and the sheet post-processing device 2.

As shown, the controller 6 of the image forming device 1 controls the scanner 3 and the printer 4 to perform scan jobs and copy jobs. Further, when the controller 6 receives data of a print job from an external terminal connected to a network, via an external interface (I/F) 8, the controller 5 causes the printer 4 to execute the print job based on the data received.

Further, in a case in which the controller 6 receives an instruction to execute stapling from a user, via the operation unit 5, the controller transmits the number of the sheets S to be stapled (stapling sheet number), information for a specified number of copies, etc., to the controller 104 of the sheet post-processing device 2.

Further, the controller 6 receives a detection signal from a sheet size detection sensor 9*a* provided to a cassette 4*a* of the printer 4 to detect the size and transport orientation (longitudinal or transverse) of the sheets S stored in the cassette 4*a*. The size and transport orientation detected by the sheet size detection sensor 9*a* become sheet information transmitted to the controller 104 of the sheet post-processing device 2.

Further, when the controller 6 receives, from a sheet ejection sensor 9*b* (FIG. 3) positioned near the ejection roller 7, a detection signal indicating detection of a sheet transport direction rear end (sheet rear end) of one of the sheets S ejected by the ejection roller 7, the controller 6 detects that one of the sheets S after printing has been ejected from the ejection roller 7. Each time ejection of one of the sheets S is detected, the controller 6 transmits a sheet ejection signal indicating that one of the sheets S has been ejected to the controller 104 of the sheet post-processing device 2.

The controller 104 of the sheet post-processing device 2 controls the stapler 103, the transport motor M1 through to the lift motor M5, the guide claw drive actuator 36, the pressing claw drive actuator 37, etc., to cause execution of alignment of the sheet stack Sb, stapling, orientation change of the pivot tray 22, transport of the sheet stack Sb from the pivot tray 22 to the front tray 51, etc., as described above.

Further, the controller 104 receives a detection signal from a home position detection sensor 31 (see FIG. 21) for detecting the CD reference plate 12 at its home position, in order to detect whether or not the CD reference plate 12 is positioned at its home position.

The home position detection sensor 31 uses, for example, a transmission type of optical sensor having an emitter and a receiver disposed with an interval therebetween.

The controller 104 can detect whether or not the CD reference plate 12 is positioned at its home position based on the detection signal from the home position detection sensor 31. Other method of detecting a home position may be used. Home position detection sensors 32-35 described below may also use a similar method of detecting corresponding home positions.

Further, the controller 104 receives a detection signal from the home position detection sensor 32 for detecting whether the CD alignment plate 13 is positioned at its home position, in order to detect whether or not the CD alignment plate 13 is positioned at its home position.

Further, the controller 104 receives a detection signal from the home position detection sensor 33 for detecting whether the FD alignment member 14 is positioned at its home position, in order to detect whether or not the FD alignment member 14 is positioned at its home position.

Further, the controller 104 receives a detection signal from the home position detection sensor 34 for detecting whether the FD transport member 15 is positioned at its home position, in order to detect whether or not the FD transport member 15 is positioned at its home position.

Further, the controller 104 receives a detection signal from the home position detection sensor 35 for detecting whether the pivot tray 22 is in the inclined orientation (home position), in order to detect whether or not the pivot tray 22 is positioned at its home position.

Further, the controller 104 can exchange data and information with the controller 6 of the image forming device 1 and acquire various types of information from the controller 6 such as an execution instruction of stapling from a user and sheet information detected by the image forming device 1.

Control Content Executed by Controller 104 of Sheet Post-Processing Device 2

Figure 24:
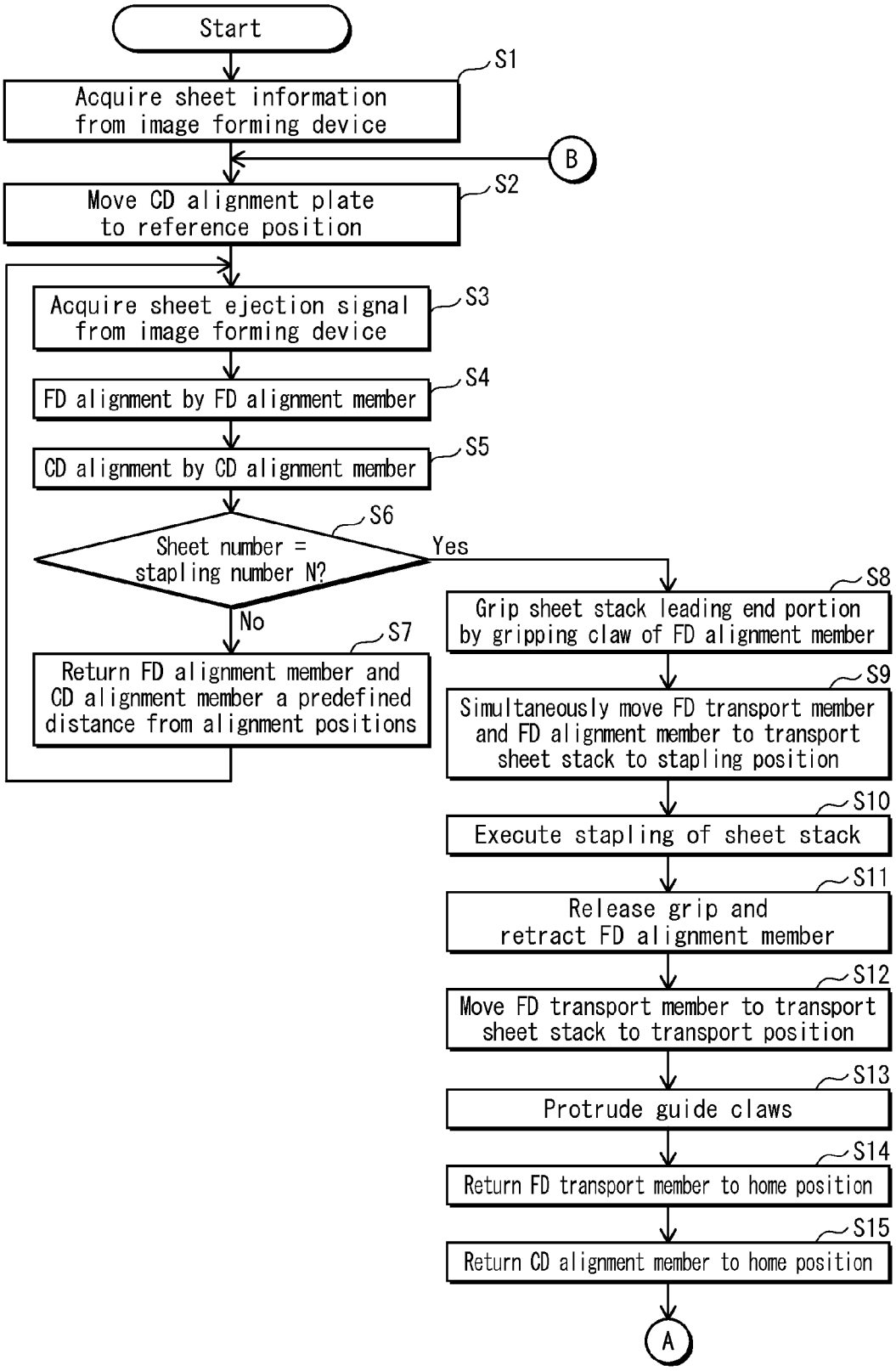
FIG. 24 is a flowchart showing a portion of a stapling control executed by the sheet post-processing device.
Figure 25:
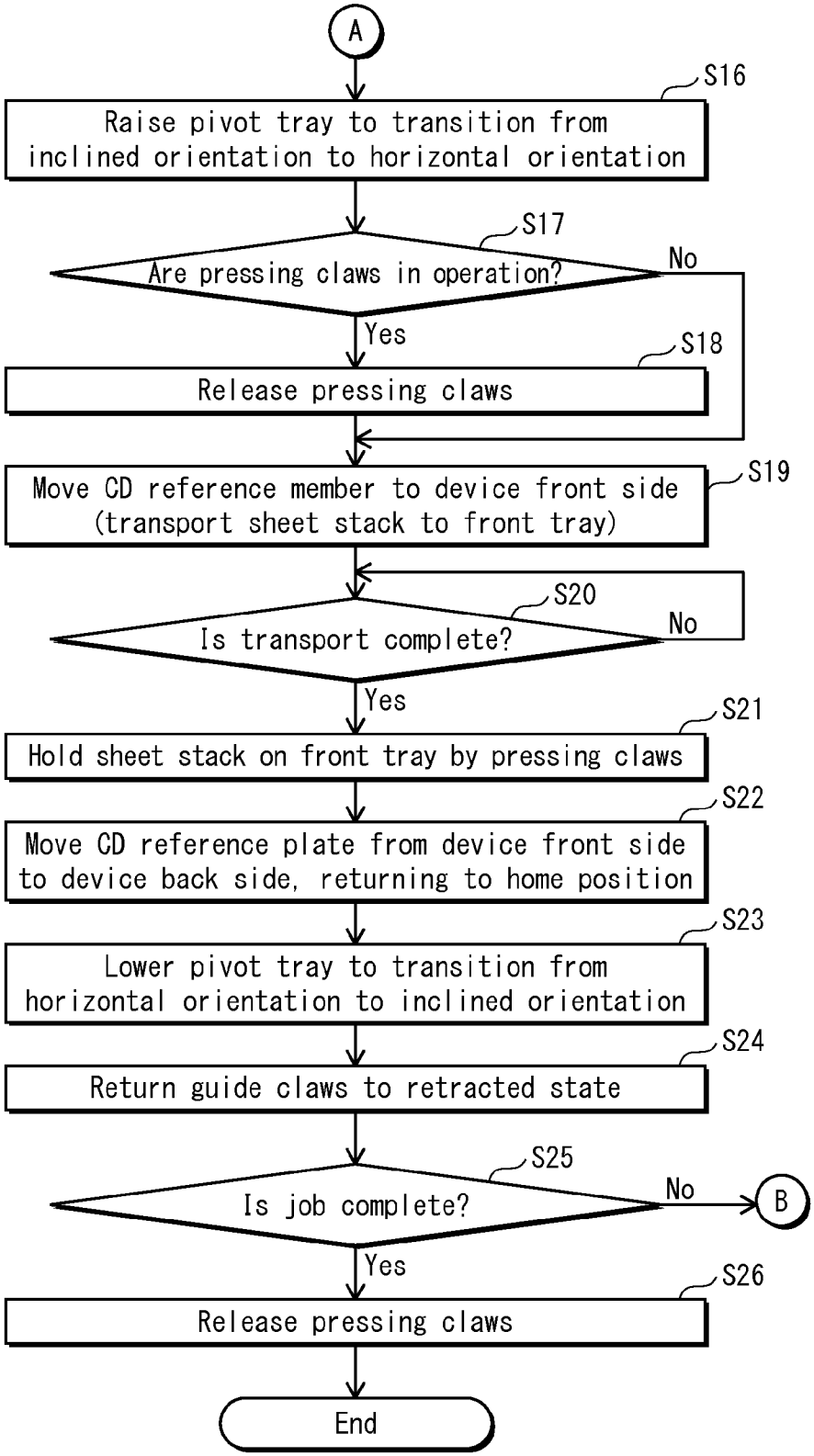
FIG. 25 is a flowchart showing a remaining portion of the stapling control executed by the sheet post-processing device.

FIG. 24 and FIG. 25 are flowcharts showing content of control of transport and stapling of the sheet stack Sb executed by the sheet post-processing device 2, executed in a case in which the controller 104 receives an instruction for stapling from the controller 6 of the image forming device 1.

As shown in FIG. 24, the controller 104 acquires sheet information corresponding to one of the sheets S ejected from the image forming device 1 (step S1).

Subsequently, the CD reference plate 12 is moved from its home position to its reference position (step S2).

Movement of the CD reference plate 12 is performed by forward rotation of the transport motor M4 by a number of revolutions or a rotation angle determined in advance as a number of revolutions or rotation angle of the transport motor M4 corresponding to a predefined distance from the home position of the CD reference plate 12 to the reference position of the CD reference plate 12. According to movement of the CD reference plate 12 towards its reference position, the CD reference plate 29 also moves to its reference position along with the CD reference plate 12.

When the controller 104 acquires a sheet ejection signal for a first one of the sheets S from the image forming device 1 (step S3), FD alignment by the FD alignment member 14 is performed as the first one of the sheets S has been transported onto the post-processing tray 11 (step S4), and CD alignment is performed by the CD alignment plate (step S5) (FIG. 4).

The FD alignment by the FD alignment member 14 is performed according to an operation in which the FD alignment member 14 moves from its home position to an FD alignment position corresponding to a sheet length L, which is based on the sheet information.

The movement distance of the FD alignment member 14 from its home position to an FD alignment position is determined in advance for each sheet length L. Movement of the FD alignment member 14 is performed by forward rotation of the FD alignment motor M3 by a number of revolutions or a rotation angle of the FD alignment motor M3 corresponding to the movement distance from the home position of the FD alignment member 14 to an FD alignment position corresponding to a respective sheet length L.

The CD alignment by the CD alignment plate 13 is performed by an operation in which the CD alignment plate 13 moves from its home position to a CD alignment position corresponding to a sheet width W, which is based on the sheet information.

The movement distance of the CD alignment plate 13 from its home position to a CD alignment position is determined in advance for each sheet width W. Movement of the CD alignment plate 13 is performed by forward rotation of the CD alignment motor M2 by a number of revolutions or a rotation angle of the CD alignment motor M2 corresponding to the movement distance from the home position of the CD alignment plate 13 to a CD alignment position corresponding to a respective sheet width W.

The controller 104 judges whether or not a number of the sheets S ejected from the image forming device 1 (sheet number) is equal to a number N of the sheets S to be stapled (stapling number) (step S6).

When the controller 104 judges that the number of sheets is not equal to the stapling number N ("NO" at step S6), an operation is performed returning both the FD alignment member 14 and the CD alignment plate 13 a predetermined distance (10 mm in the above example) from their respective alignment positions towards their respective home positions (step S7) to wait for a next one of the sheets S to be transported in.

The operation returning both the FD alignment member 14 and the CD alignment plate 13 a predetermined distance towards their respective home positions is performed by reverse rotation of the FD alignment motor M3 and the CD alignment motor M2 a number of revolutions or a rotation angle of the FD alignment motor M3 and the CD alignment motor M2 corresponding to the predetermined distance.

When the controller 104 acquires a sheet ejection signal for a second one of the sheets S from the image forming device 1 (step S3), alignment with respect to the first one of the sheets S and the second one of the sheets S stacked thereon is performed according to the processing of step S4 and step S5 before proceeding to step S6.

When the controller 104 judges that the number of sheets is not equal to the stapling number N ("NO" at step S6), processing of step S7 and steps S3 to S6 is repeated. Until the controller 104 judges that the number of sheets is equal to the stapling number N, steps S3 to S7 are repeated.

When the controller 104 judges that the number of sheets has become equal to the stapling number N ("YES" at step S6), movement of the FD transport member 15 is started, and according to the gripping inter-dependent mechanism described above in connection with FIGS. 10-12, the gripping claw 141 of the FD alignment member 14 is closed and the leading end portion of the sheet stack Sb is gripped (step S8). Subsequently, at a timing at which the FD transport member 15 contacts the rear end of the sheet stack Sb, the FD alignment member 14 is synchronized to move at the same speed as the FD transport member 15, and the sheet stack Sb is transported in the sheet transport direction to the stapling position (step S9).

Transport of the sheet stack Sb to the stapling position is performed by forward rotation of the transport motor M1 and the transport motor M3 by a number of revolutions or a rotation angle of the transport motor M1 corresponding to the transport distance determined based on the staple position information described above, causing the FD transport member 15 and the FD alignment member 14 to move.

After stapling of the sheet stack (step S10), both the FD alignment member 14 and the FD transport member 15 attempt to move the sheet stack Sb further in the X direction. However, as described above, the engagement pin 141*b* and the engagement pin 14*b* contact the guide plate 148 and the guide plate 149, respectively, and rotate, causing the gripping claw 141 to release the sheet stack Sb from the gripped state and causing the FD alignment member 14 to fall backwards and retract under the sheet stacking surface (step S11) (see FIGS. 14-16). When the home position detection sensor 33 detects the FD alignment member 14, the FD alignment motor M3 is stopped.

On the other hand, the FD transport member 15 moves further, transporting the sheet stack Sb, which has been stapled, towards the device front side to the transport position (step S12) (FIG. 18). Because the leading end of the sheet stack Sb is already stapled, transport by only the FD transport member 15 does not cause alignment problems.

Transport of the sheet stack Sb to the transport position is performed by forward rotation of the transport motor M1 by a number of revolutions or a rotation angle of the transport motor M1 corresponding to a transport distance required to transport the sheet stack Sb to the transport position, thereby moving the FD transport member 15.

Subsequently, the guide claws 16, 17 switch from the retracted state to the protruding state (step S13) (FIG. 19). This switching is performed by driving the guide claw drive actuator 36.

When switching of the guide claws 16, 17 from the retracted state to the protruding state is completed, an operation to return the FD transport member 15 to its home position is executed (step S14).

The operation to return the FD transport member 15 to its home position is performed by reverse rotation of the transport motor M1 followed by stopping the transport motor M1 when the home position detection sensor 34 detects the FD transport member 15.

Subsequently, an operation to return the CD alignment plate 13 to its home position is executed (step S15).

The operation to return the CD alignment plate 13 to its home position is performed by reverse rotation of the CD alignment motor M2 followed by stopping the CD alignment motor M2 when the home position detection sensor 32 detects the CD alignment plate 13.

Subsequently, processing advances to step S16, the pivot tray 22 is raised in order to transition from the inclined orientation to the horizontal orientation (see FIG. 20).

Transition of the pivot tray 22 from the inclined orientation to the horizontal orientation is performed by forward rotation of the lift motor M5 by a predefined number of revolutions or rotation angle of the lift motor M5 required to change orientation of the pivot tray 22 from the inclined orientation to the horizontal orientation.

Subsequently, the controller 104 judges whether or not the pressing claws 51*b* provided to the wall portion 51*b* are in operation, holding the sheet stack Sb on the front tray 51 (step S17).

In a case in which the pressing claws 52 are in operation ("YES" at step S17), after releasing the holding claws 52 (step S18), the CD reference plate 12 moves from the device back side towards the device front side, transporting the sheet stack Sb stacked on the pivot tray 22 to the device front side.

In a case in which the pressing claws 52 are not in operation ("NO" at step S17), step S18 is skipped and the sheet stack Sb is transported to the front tray 51 (step S19).

Movement of the CD reference plate 12 from the device back side to the device front side is performed by forward rotation of the transport motor M4 by a number of revolutions or a rotation angle of the transport motor M4 corresponding to a predetermined transport distance from the reference position of the CD reference plate 12 at the device back side to a predetermined position at the device front side.

When the CD reference plate 12 moves all the way to the predetermined position at the front side and transport of the sheet stack Sb to the device front side is completed ("YES" at step S20), the holding operation to cause the pressing claws 52 to hold the sheet stack Sb on the front tray 51 is executed (step S21) (FIG. 22).

The holding operation of causing the holding claws 52 to hold the sheet stack Sb is executed by driving the holding claws drive actuator 37.

Subsequently, an operation is executed to move the CD reference plate 12 from the device front side to the device back side, returning the CD reference plate 12 to its home position (step S22). The operation to return the CD reference plate 12 to its home position is performed by reverse rotation of the transport motor M4, followed by stopping the transport motor M4 when the home position detection sensor 31 detects the CD reference plate 12.

When the CD reference plate 12 returns to its home position, the pivot tray 22 is lowered to transition the pivot tray 22 from the horizontal orientation to the inclined orientation (step S23).

Transition of the pivot tray 22 from the horizontal orientation to the inclined orientation is performed by reverse rotation of the lift motor M5, followed by stopping the lift motor M5 when the home position detection sensor 35 detects that the pivot tray 22 has returned to the inclined orientation.

Subsequently, the guide claws 16, 17 return to the retracted state (step S24). Transition of the guide claws 16, 17 to the retracted state is performed by stopping drive of the guide claw drive actuator 36.

Subsequently, the controller 104 judges whether or not the job is complete (step S25). When the controller 104 judges that the job is not complete ("NO" at step S25), stapling is to be executed for a next copy of the sheet stack Sb, processing returns to step S2 shown in FIG. 24, and processing from step S2 to step S25 is executed.

Until the controller 104 judges that the job is complete, processing of steps S2 to S25 is repeated for each copy. When transport of the sheet stack Sb after stapling to the device front side is complete for each copy, the controller 104 judges that the job is complete ("YES" at step S25), and after releasing hold of the sheet stack Sb by the pressing claws 52 (step S26), processing of the control ends.

Figure 26:
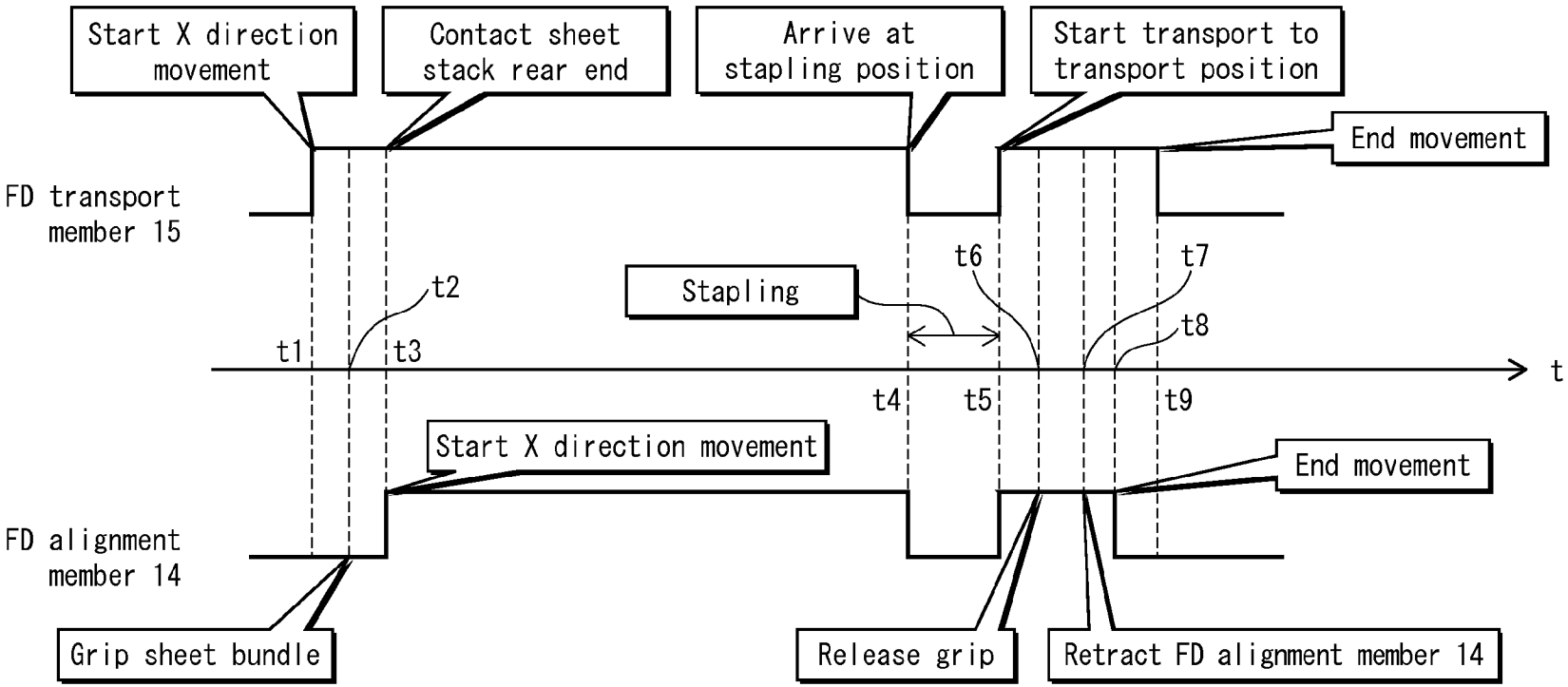
FIG. 26 is a time chart showing timing of movement of the FD transport member and the FD alignment member, and timing of gripping operation by the gripping claw.

FIG. 26 is a time chart more specifically showing timing of movement in the X direction of the FD transport member 15 and the FD alignment member 14, and timing of starting and releasing gripping of the gripping claw 141.

When the FD transport member 15 starts moving from its home position, in the X direction (time t1), according to the gripping inter-dependent mechanism already described, the lever member 147 rotates in the R direction via movement of the slide member 157 in the Q direction (FIG. 11), the lock of the restriction member 147*a* is removed, the gripping claw 141 falls in the direction of the sheet stack Sb according to the biasing force of the torsion spring 141*c*, and the sheet stack Sb is gripped (time t2).

The FD transport member 15 moves further in the X direction and at the same time as the FD transport member 15 contacts the rear end of the sheet stack Sb (time t3), the FD alignment member 14 also starts moving in the X direction at the same speed as the FD transport member 15, thereby transporting the sheet stack Sb towards the stapling position. Time t3 for synchronizing and moving the FD alignment member 14 with the FD transport member 15 may, for example, be obtained by a predefined amount of time passing from time t1.

Subsequently, when the sheet stack Sb arrives at the stapling position, movement is temporarily stopped (time t4) and stapling is executed by the stapler 103.

When stapling is complete, the FD transport member 15 and the FD alignment member 14 again start moving in the X direction (time t5). Partway, the engagement pin 141*b* of the gripping claw 141 of the FD alignment member 14 contacts the guide plate 148, causing the gripping claw 141 to release the sheet stack Sb from the gripped state (time t6, FIG. 13 and FIG. 14) and further, the engagement pin 14*b* of the FD alignment member 14 contacts the guide plate 149, causing the FD alignment member to fall back in the X direction and retract under the sheet stacking surface (time t7, FIG. 15 and FIG. 16) and stop moving (time t8).

Meanwhile, the FD transport member 15 continues to push the sheet stack Sb in the X direction, but as described above the gripping of the sheet stack Sb by the gripping claw 141 is released and the FD alignment member 14 falls back in the X direction and retracts under the sheet stacking surface, and therefore the stopping of movement of the FD alignment member 14 does not hinder movement of the sheet stack Sb. When the sheet stack Sb arrives at the transport position, the movement of the FD transport member is completed (time t9).

Above, according to the present embodiment, in the sheet post-processing device 2 positioned in the space 1*a* between the scanner 3 and the printer 4 of the image forming device 1, the sheet stack Sb composed of one of the sheets S or a plurality of the sheets S ejected from the image forming device 1 is temporarily stored on the post-processing tray 11 at the device back side. Subsequently, while the leading end portion of the sheet stack Sb is gripped by the gripping claw 141 of the FD alignment member 14 and the FD transport member 15 is in contact with the rear end portion of the sheet stack Sb, the sheet stack can be transported to the post-processing position, and therefore the post-processing can be executed while maintaining alignment of the sheet stack Sb.

Subsequently, the sheet stack Sb on the post-processing tray 11 is transported from the device back side towards the device front side to the front tray 51 positioned at the device front side, and stored on the front tray 51.

In this way, while device dimensions can be reduced in the device lateral direction, a user can easily retrieve the sheets S or the sheet stack Sb stored on the front tray 51, improving ease of use.

The present invention is not limited to the sheet post-processing device 2, and may be an image forming system including the image forming device 1 and the sheet post-processing device 2 mounted thereto.

Modifications

Above, the present invention is described based on the embodiment, but the present invention is of course not limited to the above embodiment, and the following modifications of the present invention may be considered.

(1) According to the above embodiment, the guide plate 148 and the guide plate 149 are located at an end portion of the post-processing tray 11 downstream in the X direction. However, the guide plate 148 and the guide plate 149 may be located closer to the stapler 103 so that as soon as the sheet stack Sb is to be transported from the stapling position, gripping by the gripping claw 141 is released and the FD alignment member 14 retracts under the sheet stacking surface. After stapling, alignment of the leading end portion of the sheet stack Sb will not be lost.

(2) According to the above embodiment, gripping and releasing of the sheet stack Sb by the gripping claw 141 and retraction of the FD alignment member 14 is performed according to the gripping inter-dependent mechanism. However, a dedicated gripping drive source for the gripping claw 141 and a dedicated retraction drive source for the FD alignment member 14 may be provided, and timing of operation of the dedicated gripping drive source and the dedicated retraction drive source may be controlled by the controller 104 as shown in FIG. 26.

(3) According to the above embodiment, the front tray 51 is provided and the sheet stack Sb after stapling is transported to the front tray 51 so that the sheet stack Sb is easily taken from the device front side and width of the image forming device is minimized. However, the front tray 51 may not be required, and a configuration is possible in which the sheet stack Sb is transported from the stapling position in the X direction and the leading end portion of the sheet stack Sb may protrude slightly from an end portion of the post-processing tray 11, allowing a user to take the sheet stack Sb.

(4) According to the above embodiment, initially, the sheet stacking surface of the post-processing tray 11 is inclined downwards towards the ejection roller 7. However, the present invention is not limited in this way.

By adopting the inclined orientation of the embodiment, the sheets S ejected from the ejection roller 7 slide on the sheet stacking surface of the post-processing tray 11 so that the rear ends of the sheets S contact the stoppers 18*a*, 18*b*. Thus, FD alignment is easily performed by causing the FD alignment member 14, which is downstream in the sheet transport direction, to contact the leading end portion of the sheet stack Sb and, by using the movement mechanism for alignment of the FD alignment member 14, the sheet stack Sb is transported to the stapling position in cooperation with the FD transport member 15 in state in which the leading end portion of the sheet stack Sb is gripped by the gripping claw 141. Accordingly, the mechanism for FD alignment and transport of the sheet stack Sb is advantageously simplified.

(5) According to the above embodiment, the pivot tray 22 is pivotable up and down, but the present invention is not limited in this way. For example, instead of the pivot tray 22, a horizontal tray may be provided that is movable up and down while maintaining a horizontal orientation.

(6) According to the above embodiment, the FD alignment member 14 is provided with the gripping claw 141 to grip the leading end portion of the sheet stack Sb until the sheet stack Sb is transported to the stapling position. However, as long as the FD alignment member 14 and the FD transport member 15 are in contact with ends of the sheet stack Sb, the leading end portion of the sheet stack Sb need not be gripped. The sheet stack Sb may be transported without losing alignment by simultaneous movement of the FD alignment member 14 and the FD transport member 15 in contact with the sheet stack Sb, and in this case the holding claw 141 to hold the leading end portion of the sheet stack Sb is not required.

(7) According to the above embodiment, an example is described in which the image forming device 1 is a multi-function device. However, as long as the image forming device is provided with the scanner 3 (image reader), the printer 4 (image former) below the scanner 3, and the space 1*a* therebetween, at least part of the space 1*a* defining the opening 1*b* to the device front side, the image forming device may be, for example, a copy machine, a facsimile machine, etc.

Further, as the sheet post-processing device 2 disposed in the space 1*a* of the image forming device 1, according to the above embodiment, an example configuration is described that can execute a stapling function. However, post-processing is not limited to stapling, and the sheet post-processing device may, for example, perform a binding process or a punching process to punch holes in a sheet stack on the post-processing tray 11.

Further, each element described above such as the CD reference plate 12, the FD alignment member 14, etc., is not limited to the shape, number, etc., described above, and may be any shape, number, etc., appropriate for the device.

Further, the present invention may be any possible combination of content of the above embodiment and modifications.

Although the present invention has been fully described by way of examples with reference to the accompanying drawings, it is to be noted that various changes and modification will be apparent to those skilled in the art. Therefore, unless such changes and modifications depart from the scope of the present invention, they should be construed as being included therein.

What is claimed is:

1. A sheet post-processing device for, after sheets that are ejected from an image forming device are stored on a storage tray, transporting the sheets in a transport direction to a post-processing position and performing post processing at the post-processing position, the sheet post-processing device comprising:

an aligner configured to align sheets on the storage tray; and a transporter configured to transport to the post-processing position a stack of sheets aligned by the aligner, wherein the transporter includes a first contact member and a second contact member, the transporter transports the stack to the post-processing position by simultaneous movement of the first contact member and the second contact member in the transport direction while the first contact member is in contact with a rear end portion of the stack in the transport direction and the second contact member is in contact with a leading end portion of the stack in the transport direction;

the second contact member includes a gripper that grips the leading end portion when the stack is being transported;

the gripper completes a gripping operation before the stack is transported;

the first contact member is moved into contact with the rear end portion of the stack in the transport direction while the second contact member is in contact with the leading end portion of the stack in the transport direction, the gripper completes the gripping operation while the first contact member is moved into contact with the rear end portion of the stack in the transport direction; and the transporter includes a gripping inter-dependent mechanism that causes the gripping operation to be linked to the movement of the first contact member into contact with the rear end portion of the stack in the transport direction.

2. The sheet post-processing device of claim 1, wherein the second contact member is movable back and forth along the transport direction independently of the first contact member, and the second contact member is part of the aligner and configured to align the sheets on the storage tray in the transport direction by contacting leading ends of the sheets on the storage tray.

3. The sheet post-processing device of claim 1, wherein the transporter includes a retractor that causes the second contact member to retract under a sheet stacking surface of the storage tray, and after post-processing of the stack at the post-processing position, and after the retractor causes the second contact member to retract under the sheet stacking surface, the first contact member is caused to push the rear end portion of the stack to transport the stack farther in the transport direction.

4. The sheet post-processing device of claim 1, wherein a sheet stacking surface of the storage tray is inclined so that, in the transport direction, an upstream end of the sheet stacking surface is lower than a downstream end of the sheet stacking surface.

5. The sheet post-processing device of claim 1, wherein the gripper inter-dependent mechanism includes a restriction member that restricts the gripping operation of the gripper, and the movement of the first contact member releases the restriction of the restriction member, causing the gripping operation of the gripper to be performed.

6. The sheet post-processing device of claim 1, wherein a sheet stacking surface of the storage tray is sloped downwards from downstream in the transport direction to upstream in the transport direction.

7. An image forming system comprising:

an image forming device provided with an image reader and an image former below the image reader, and having a space therebetween, at least part of the space defining an opening to a front side of the image forming device; and a sheet post-processing device disposed in the space of the image forming device, wherein the sheet post-processing device is for, after sheets that are ejected from the image forming device are stored on a storage tray, transporting the sheets in a transport direction to a post-processing position and performing post processing at the post-processing position, the sheet post-processing device comprising:

an aligner configured to align sheets on the storage tray; and a transporter configured to transport to the post-processing position a stack of sheets aligned by the aligner, wherein the transporter includes a first contact member and a second contact member, the transporter transports the stack to the post-processing position by simultaneous movement of the first contact member and the second contact member in the transport direction while the first contact member is in contact with a rear end portion of the stack in the transport direction and the second contact member is in contact with a leading end portion of the stack in the transport direction;

the second contact member includes a gripper that grips the leading end portion when the stack is being transported;

the gripper completes a gripping operation before the stack is transported;

the first contact member is moved into contact with the rear end portion of the stack in the transport direction while the second contact member is in contact with the leading end portion of the stack in the transport direction, the gripper completes the gripping operation while the first contact member is moved into contact with the rear end portion of the stack in the transport direction; and the transporter includes a gripping inter-dependent mechanism that causes the gripping operation to be linked to the movement of the first contact member into contact with the rear end portion of the stack in the transport direction.

8. The image forming system of claim 7, wherein the second contact member is movable back and forth along the transport direction independently of the first contact member, and the second contact member is part of the aligner and configured to align the sheets on the storage tray in the transport direction by contacting leading ends of the sheets on the storage tray.

9. The image forming system of claim 7, wherein the transporter includes a retractor that causes the second contact member to retract under a sheet stacking surface of the storage tray, and after post-processing of the stack at the post-processing position, and after the retractor causes the second contact member to retract under the sheet stacking surface, the first contact member is caused to push the rear end portion of the stack to transport the stack farther in the transport direction.

10. The image forming system of claim 7, wherein a sheet stacking surface of the storage tray is inclined so that, in the transport direction, an upstream end of the sheet stacking surface is lower than a downstream end of the sheet stacking surface.

11. The image forming system of claim 7, wherein the gripper inter-dependent mechanism includes a restriction member that restricts the gripping operation of the gripper, and the movement of the first contact member releases the restriction of the restriction member, causing the gripping operation of the gripper to be performed.

12. The sheet post-processing system of claim 7, wherein a sheet stacking surface of the storage tray is sloped downwards from downstream in the transport direction to upstream in the transport direction.

* * * * *